US007255069B2

(12) United States Patent
Liebert

(10) Patent No.: US 7,255,069 B2
(45) Date of Patent: Aug. 14, 2007

(54) CYLINDER SLEEVE SUPPORT FOR AN INTERNAL COMBUSTION ENGINE

(75) Inventor: Jeffrey W. Liebert, New Salisbury, IN (US)

(73) Assignee: Electromechanical Research Laboratories, Inc., New Albany, IN (US)

( * ) Notice: Subject to any disclaimer, the term of this patent is extended or adjusted under 35 U.S.C. 154(b) by 0 days.

(21) Appl. No.: 11/459,750

(22) Filed: Jul. 25, 2006

(65) Prior Publication Data

US 2006/0249116 A1 Nov. 9, 2006

Related U.S. Application Data

(63) Continuation-in-part of application No. 10/624,876, filed on Jul. 22, 2003.

(60) Provisional application No. 60/472,589, filed on May 22, 2003.

(51) Int. Cl.
*F02F 1/14* (2006.01)
*F02F 1/42* (2006.01)

(52) U.S. Cl. ..... 123/41.79; 123/41.67; 123/41.81; 123/193.5; 277/597

(58) Field of Classification Search ..... 123/193.5, 123/193.2, 193.3, 41.83, 41.84, 41.79, 41.67, 123/41.72; 277/590, 591, 597
See application file for complete search history.

(56) References Cited

U.S. PATENT DOCUMENTS

| | | | | |
|---|---|---|---|---|
| 1,968,449 | A * | 7/1934 | Hefti | 123/41.8 |
| 2,279,671 | A | 4/1942 | Ford | |
| 3,714,931 | A * | 2/1973 | Neitz et al. | 123/41.79 |
| 3,800,751 | A * | 4/1974 | Glassey et al. | 123/41.84 |
| 3,853,099 | A * | 12/1974 | Feather et al. | 123/41.82 R |
| 4,305,348 | A | 12/1981 | Martin | |
| 4,419,971 | A | 12/1983 | Nakamura et al. | |
| 4,524,498 | A | 6/1985 | Hartsock | |
| 4,796,572 | A | 1/1989 | Heydrich | |
| 5,005,469 | A | 4/1991 | Ohta | |
| 5,150,668 | A * | 9/1992 | Bock | 123/41.8 |
| 5,343,837 | A | 9/1994 | Ward et al. | |
| 5,575,251 | A * | 11/1996 | Bock | 123/193.3 |
| 5,582,144 | A | 12/1996 | Mizutani | |
| 5,603,515 | A | 2/1997 | Bock | |
| 6,145,481 | A | 11/2000 | Bock et al. | |
| 6,336,639 | B1 | 1/2002 | Ishida et al. | |
| 6,357,758 | B1 | 3/2002 | Zurfluh | |
| 6,439,173 | B1 | 8/2002 | Chung | |
| 6,532,915 | B2 | 3/2003 | Thompson | |

* cited by examiner

*Primary Examiner*—Carl S. Miller
(74) *Attorney, Agent, or Firm*—Woodard, Emhardt, Moriarty, McNett & Henry LLP

(57) ABSTRACT

The disclosed multi-cylinder, poppet-valved engine, has replacement cylinder sleeves larger than the original sleeves, and laterally supported near their upper ends by an aluminum alloy plate having a continuous flange or boss projecting into the cylinder block. The flange has an inner perimeter surface having a profile fittingly engaging upper exterior cylindrical surfaces of the sleeves providing lateral support to the sleeves and heat transfer from the sleeves to coolant and to the block. The flange further provides a coolant groove that circulates coolant around the perimeter of the cylinder sleeves to further the heat transfer from the sleeves to the coolant and to the block. The plate is sealed to the block and head with a spacing and gasketing to accommodate thermal expansion while avoiding combustion gas leakage at the cylinder sleeve tops.

26 Claims, 23 Drawing Sheets

CYLINDER SLEEVE SUPPORT FOR AN INTERNAL COMBUSTION ENGINE

CROSS REFERENCE TO RELATED APPLICATIONS

The present application is a continuation-in-part of U.S. application Ser. No. 10/624,876, filed Jul. 22, 2003, which claims the benefit of U.S. Provisional Application Ser. No. 60/472,589, filed on May 22, 2003, the contents of which applications are hereby incorporated herein by reference in their entirety.

FIELD OF THE INVENTION

The present invention generally relates to internal combustion engines, and more particularly relates to devices and methods for supporting one or more cylinder sleeves in an internal combustion engine.

BACKGROUND OF THE INVENTION

A traditional type of internal combustion engine utilizes a cylinder and reciprocating piston arrangement. A variable-size combustion chamber is typically formed with a cylinder that is effectively closed at one end and has a moveable piston at the other end. A combustible gas, or mixture of a combustible fluid and air, is introduced into the combustion chamber and then typically compressed by the piston and ignited. The ignited gas, or mixture, exerts a force on the piston in the direction that increases the volume of the combustion chamber. The linear movement of the moving piston is then converted to rotational movement by connecting the piston to a crankshaft.

A typical internal combustion engine design includes an engine block that encases the combustion cylinders. Many designs utilize engine block materials that are not well-suited for use as the walls of the combustion cylinder. Thus, cylinder sleeves fabricated from a material that is more suitable to withstand the environment associated with the combustion chamber are used to define the cylinder walls. A common problem with cylinder sleeves, however, is their tendency to deteriorate, especially near the top of the cylinder when the sleeve extends beyond the support limits of the engine block. Previous inventions have attempted to support the upper portion of the cylinder sleeve using ring-shaped "block guards." However, block guards create problems with heat transfer and restriction of circulating cooling fluid about the cylinder sleeve, and particularly about the upper portion of the cylinder sleeve adjacent the block guard.

Currently, there is an interest among certain automobile enthusiasts in converting a conventional passenger car into a performance car. One approach is to increase power of the existing engine by increasing the diameter of the combustion cylinder and/or stroke displacement. Another approach is to increase power of the existing engine by replacing the existing cylinder sleeves with cylinder sleeves able to withstand higher stresses. The present invention facilitates this approach via an apparatus and method by which cylinder sleeves larger and/or stronger than those originally employed in an existing engine may be provided for support and cooling for increased longevity.

Thus, there is a general need in the industry to provide improved devices and methods for supporting one or more cylinder sleeves in an internal combustion engine. The present invention meets this need and provides other benefits and advantages in a novel and unobvious manner.

SUMMARY OF THE INVENTION

The present invention relates generally to improved devices and methods for supporting one or more cylinder sleeves in an internal combustion engine. While the actual nature of the invention covered herein can only be determined with reference to the claims appended hereto, the invention can be described briefly and broadly as improving the power and durability potential of a conventional internal combustion reciprocating piston engine by installing more durable replacement cylinder sleeves, and supporting upper ends of the replacement sleeves laterally with a unique plate having a flange, or boss, with a sleeve-supporting surface providing lateral support for the sleeves, and transferring heat from the sleeves to the engine coolant.

One aspect of the present invention provides an apparatus for supporting a cylinder sleeve in a reciprocating piston internal combustion engine that has an engine block with a block connection surface. The engine also has an engine head with a head connection surface, where the engine block and the engine head are connected to one another along their respective connection surfaces. The cylinder sleeve has a sleeve outer surface portion that defines a sleeve perimeter. The apparatus also includes a support member that is connectable between the block connection surface and the head connection surface for substantially overlaying the block connection surface and for substantially underlaying the head connection surface. The support member includes an inner perimeter support portion that defines a groove and includes a support surface. The groove is adapted and configured to circulate fluid around the perimeter of the cylinder sleeve, and the support surface laterally supports the sleeve outer surface portion.

Another aspect of the present invention provides a multi-cylinder internal combustion reciprocating engine cooled, at least in part, by liquid coolant. The engine includes a cylinder block with a top face in a first plane. The block has a plurality of cylinder tubes having parallel cylindrical axes that are substantially perpendicular to the first plane. The block further has at least one step surface in a second plane parallel to and below the first plane. The engine also includes a plurality of cylinder sleeves for receiving reciprocating engine pistons therein, where one of the sleeves is secured in each of the cylinder tubes. Each sleeve has an upper end, with the upper ends in a third plane that is parallel to and above the first plane. Each of the sleeves also has an outer cylindrical wall with an upper portion. The engine further has a support plate on the block with an inner perimeter surface and a groove. The inner perimeter surface snugly engages the upper portions of the sleeves and the groove is adapted and configured to guide coolant along and around the upper portions of the sleeves when the engine is operating.

Still another aspect of the present invention provides an apparatus for use within a liquid cooled reciprocating piston internal combustion engine that has a cylinder sleeve mounted to an engine block. The apparatus further has an engine head mounted to the engine block and a cooling fluid. The apparatus further includes means for maintaining a specified separation between the engine block and the engine head using a plate mounted between the engine block and the engine head where the plate is further mounted to the cylinder sleeve. The apparatus also includes means for cooling the cylinder sleeve using a groove in the plate that provides for direct contact between the cooling fluid and the cylinder sleeve; and means for minimizing lateral movement of the cylinder sleeve using the plate.

Yet a further aspect of the present invention provides an internal combustion reciprocating engine with a cylinder block, where the cylinder block as a flat surface block top and a plurality of combustion cylinders extending downward from the top. The engine further includes a cylinder liner sleeve in each of the cylinders. Also included in the engine is a plate mounted on the block top, where the plate has a plate top and a plate bottom, and a hole through the plate from the plate top to the plate bottom. The hole has an inner perimeter wall that engages upper portions of the sleeves throughout more than half the circumference of the upper portions of the sleeves. The engine also has a cylinder head mounted on the sleeves, which covers the cylinder sleeves. The engine further has at least one coolant passageway extending through the block and the plate, where the coolant passageway has a portion defined by the portions of the sleeves engaged by the inner perimeter wall of the plate. Coolant that moves through the defined portion of the passageway directly contacts the sleeves.

Further aspects, features and advantages of the present invention shall become apparent from the detailed drawings and descriptions provided herein.

Each embodiment described herein is not intended to address every aspect described herein, and each embodiment does not necessarily include each feature described.

DESCRIPTION OF THE ILLUSTRATED EMBODIMENTS

Figure 1:
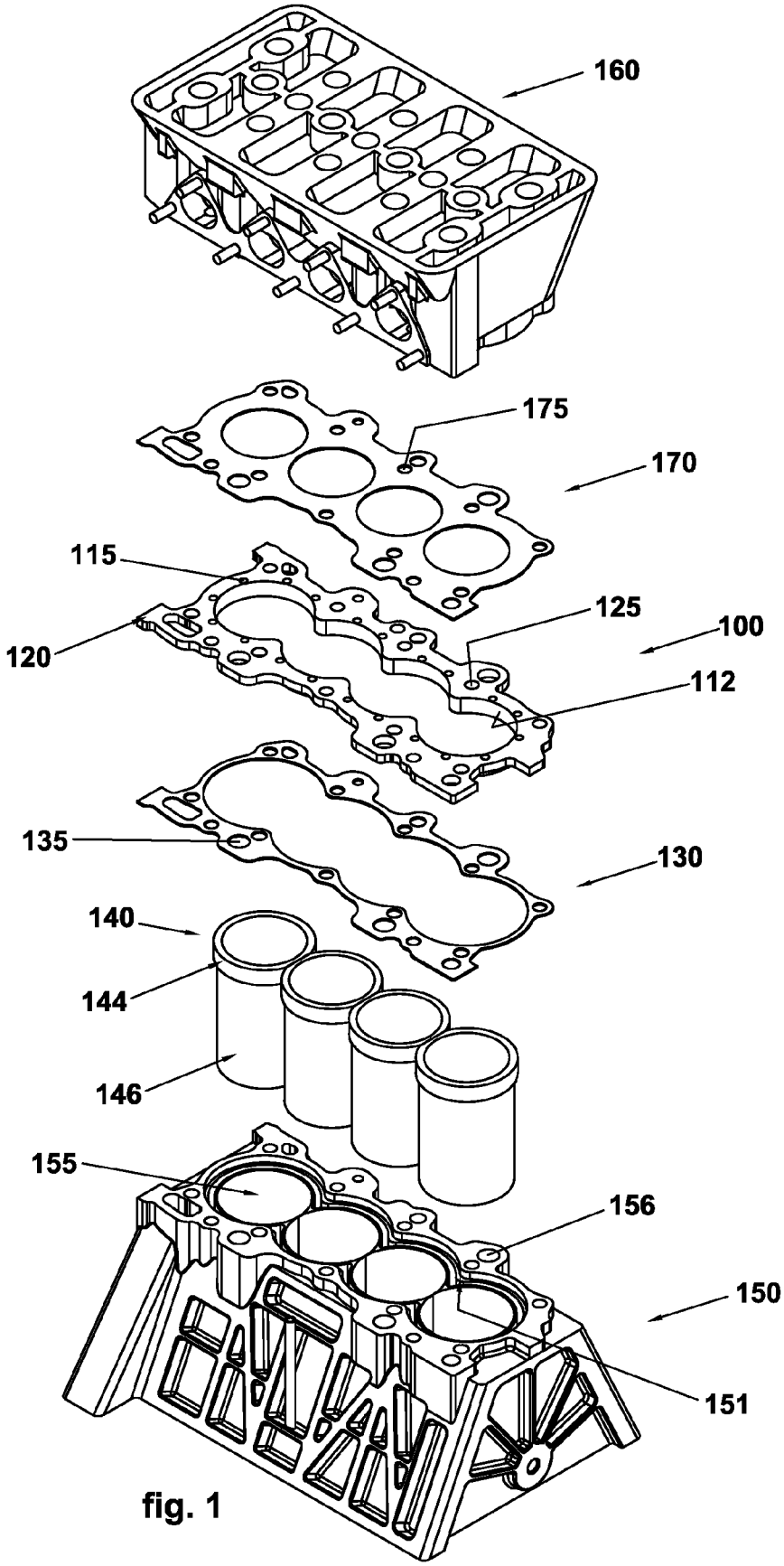
FIG. 1 is an exploded view of a portion of an internal combustion engine, including a cylinder sleeve support plate according to one embodiment of the present invention.
Figure 2:
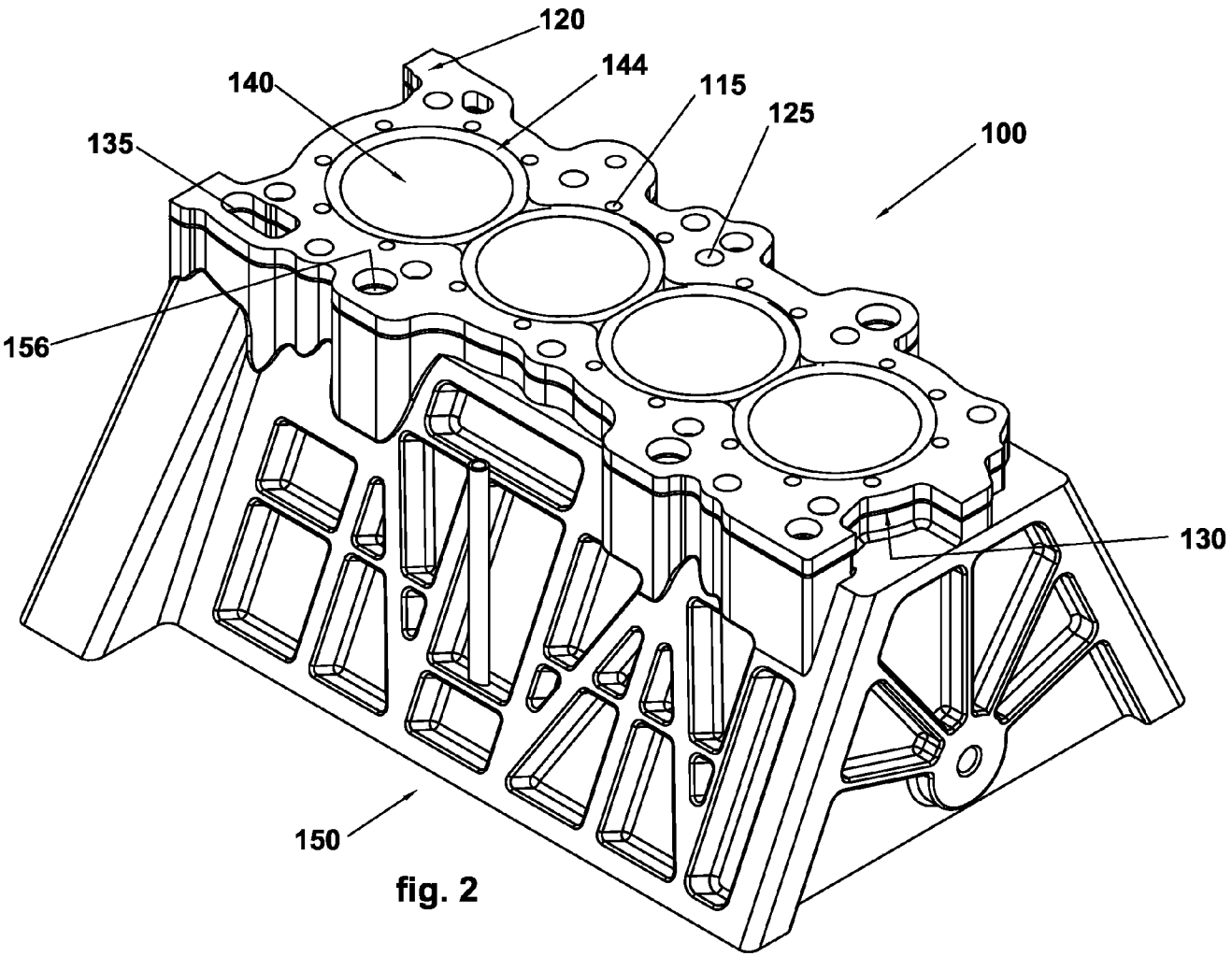
FIG. 2 is an assembled perspective view of the engine components illustrated in FIG. 1, with the engine head and head gasket removed for clarity.
Figure 3:
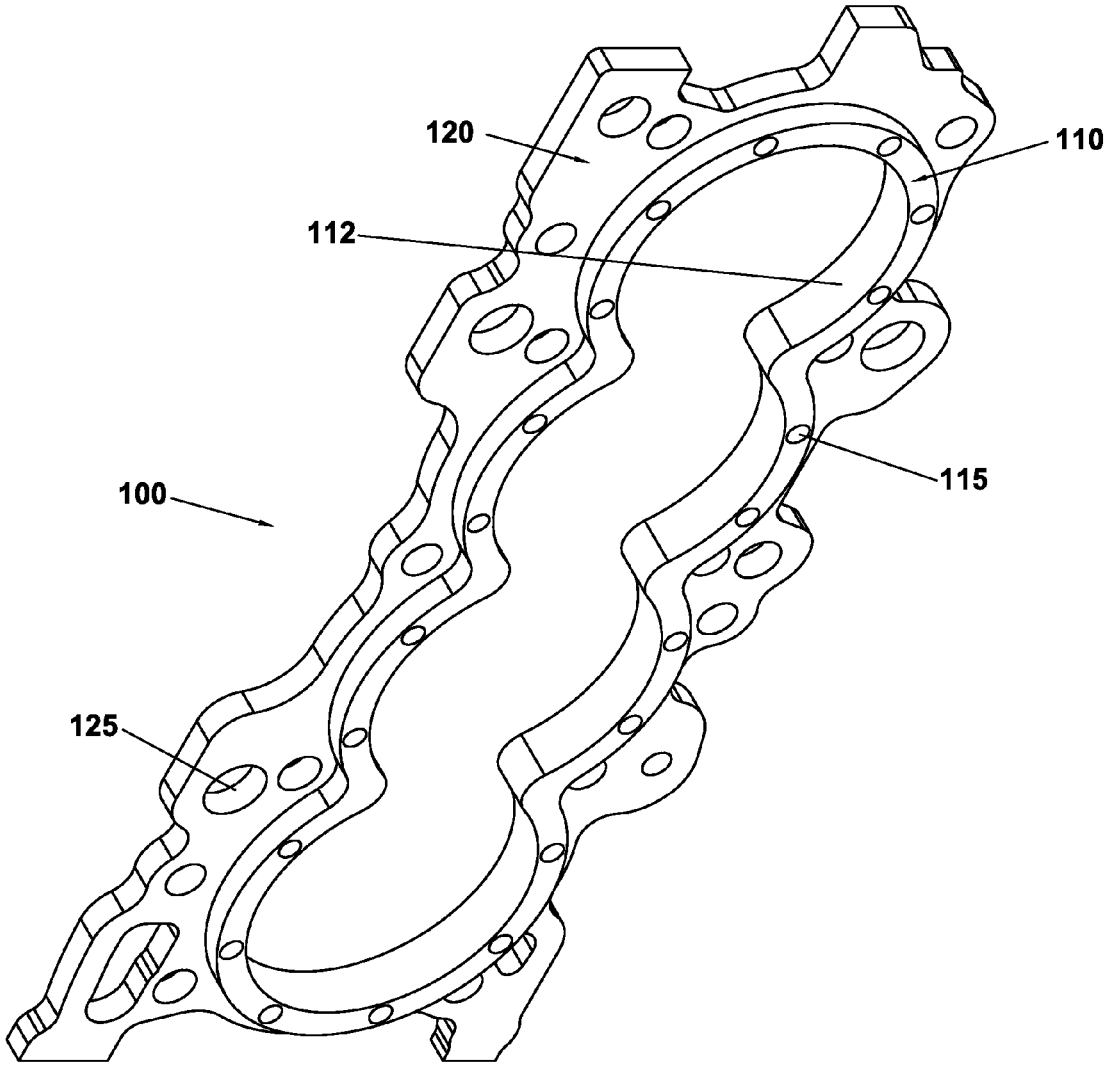
FIG. 3 is a bottom perspective view of the cylinder sleeve support plate illustrated in FIG. 1.

For the purposes of promoting an understanding of the principles of the invention, reference will now be made to the embodiments illustrated in the drawings and specific language will be used to describe the same. It will nevertheless be understood that no limitation of the scope of the invention is hereby intended, such alterations and further modifications in the illustrated devices, and such further applications of the principles of the invention as illustrated herein being contemplated as would normally occur to one skilled in the art to which the invention relates.

Referring to FIGS. 1-5, illustrated therein are select components of an open deck type internal combustion engine including a cylinder sleeve support plate 100 according to one embodiment of the present invention. The engine block 150 has four cylinder bores 155 into which respective cylinder sleeves 140 are placed. It should be understood, however, that the present invention is also applicable to engine blocks having less than or greater than four cylinder bores. The bores 155 may be formed by drilling out the original cylinder sleeves and/or the cylinder bores in the block 150, or may alternatively comprise the original cylinder bores in the block 150. Each cylinder bore 155 may have an individual and separate cylinder sleeve 140 positioned therein, or multiple cylinder bores 155 may have an array of interconnected cylinder sleeves 140 positioned therein. The cylinder sleeve 140 is comprised of lower portion 146 and upper portion 144. It should be understood that the length of the cylinder sleeve 140 may be greater than, equal to, or less than the depth of cylinder bore 155.

In one embodiment of the invention, modification of the engine block 150 includes boring out the original cylinder sleeves and/or the cylinder bores, and counter-boring the top of the cylinder bore 155 to provide an annular step or ridge 151 in the upper portion of cylinder bore 155 into which the upper portion 144 of the sleeve 140 and an annular boss portion 110 defined by the plate 100 are received. With the replacement sleeve 140 press-fitted into the cylinder bore 155, the plate 100 is then installed with the inner surface 112 of the annular boss 110 preferably fitting snugly against the upper portion 144 of the sleeve to laterally support the cylinder sleeve 140. In one embodiment of the invention, the upper surface of the engine block 150 is machined or cut down such that the upper surface of the installed support plate 100 is positioned at the original height of the upper surface of the engine block 150. In this manner, the original engine components, including the engine head, rods, etc., can be reinstalled without replacement or modification. However, it should be understood that in other embodiments of the invention, the engine block 150 need not necessarily be machined or cut down. In this manner, if desired, engine displacement may be increased beyond that of the original engine displacement by increasing the stroke and providing a longer cylinder sleeve 140 such that the upper portion of the cylinder sleeve 140 extends above the upper surface of the engine block 150.

When referring to a "slip-fit," also referred to as a "clearance-fit," it is understood that there is some clearance, such as a slight gap, between two items when the items are fitted together. Preferably the clearance is greater than approximately 0.0003 (three ten-thousandths) inches. More preferably, the clearance is greater than approximately 0.0005 (five ten-thousandths) inches. Even more preferably, the clearance is between approximately 0.0005 (five ten-thousandths) inches and 0.001 (one one-thousandth) inches.

When referring to an "interference fit," it is understood that two items are equally dimensioned and there is neither a gap nor an overlap when items are fitted together. Preferably the tolerance of the equal dimensions is within approximately 0.001 (one one-thousandth) inches. More preferably, the tolerance of the equal dimensions is within approximately 0.0005 (five ten-thousandths) inches. Even more preferably the tolerance of the equal dimensions is within approximately 0.0003 (three ten-thousandths) inches.

When referring to a "press-fit," it is understood that there is an overlap in dimensions between two items when the two items are fitted together. Preferably the overlap is greater than approximately 0.0003 (three ten-thousandths) inches. More preferably, the overlap is greater than approximately 0.0005 (five ten-thousandths) inches. Even more preferably, the overlap is between approximately 0.001 (one one-thousandth) inches and 0.0015 (one-and-one-half one-thousandth) inches.

The engine block 150 may be manufactured from various types of durable materials, such as, for example, steel, iron, aluminum or heat resistant plastics, although other materials with similar properties may also be utilized. In one embodiment of the invention, the cylinder sleeve 140 is formed of a durable, heat resistant material, such as, for example, various types of irons, including ductile and cast iron, various types of steels, including chrome alloy steel, or certain types of ceramics. However, other suitable materials may also be utilized. Additionally, the cylinder sleeve 140 may be formed of more than one material, such as, for example, a metal alloy material or a metal coated with a ceramic material.

Figure 4:
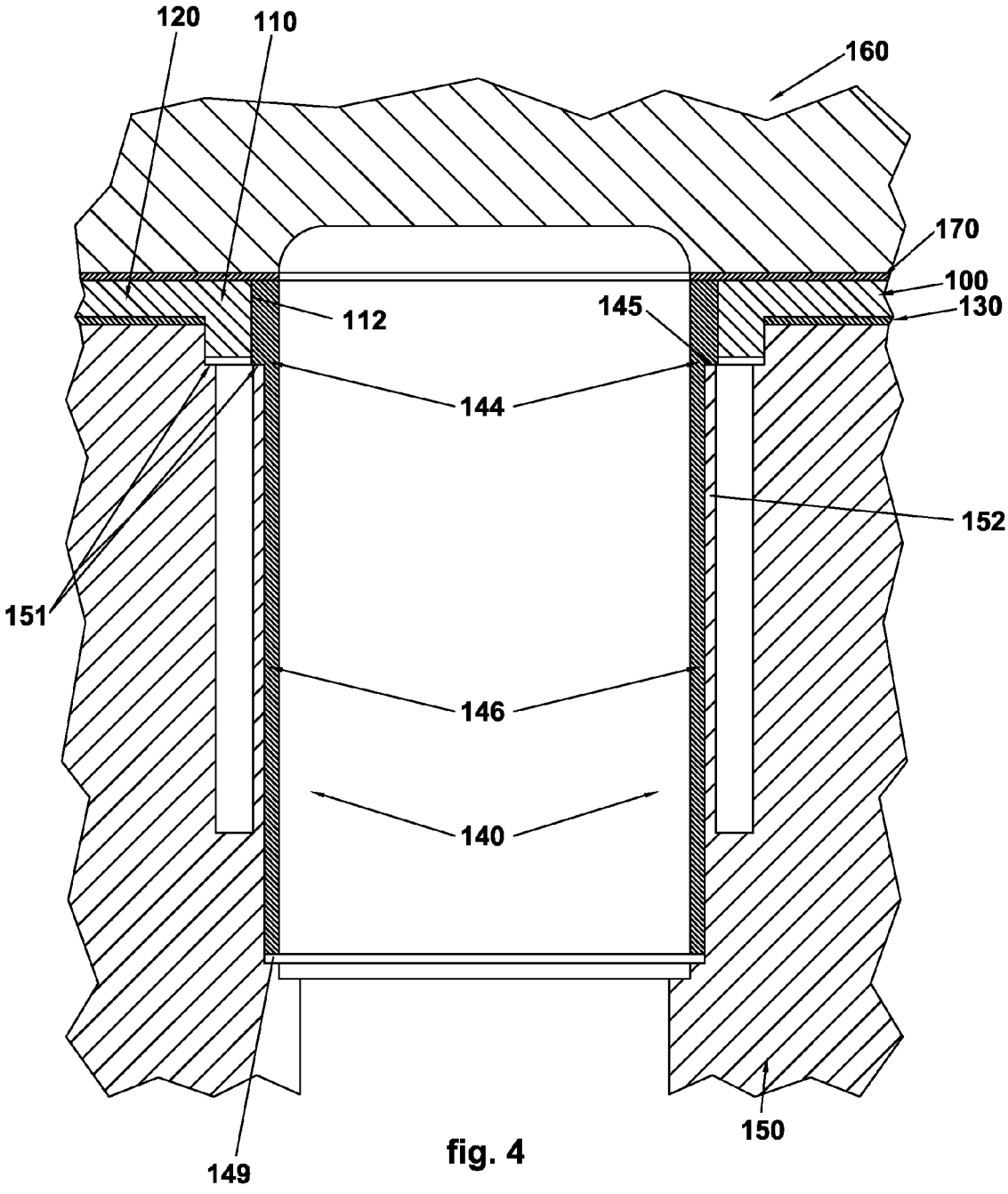
FIG. 4 is an enlarged cross-sectional view taken through one of the combustion cylinders of an engine assembled with the engine components illustrated in FIG. 1.
Figure 5:
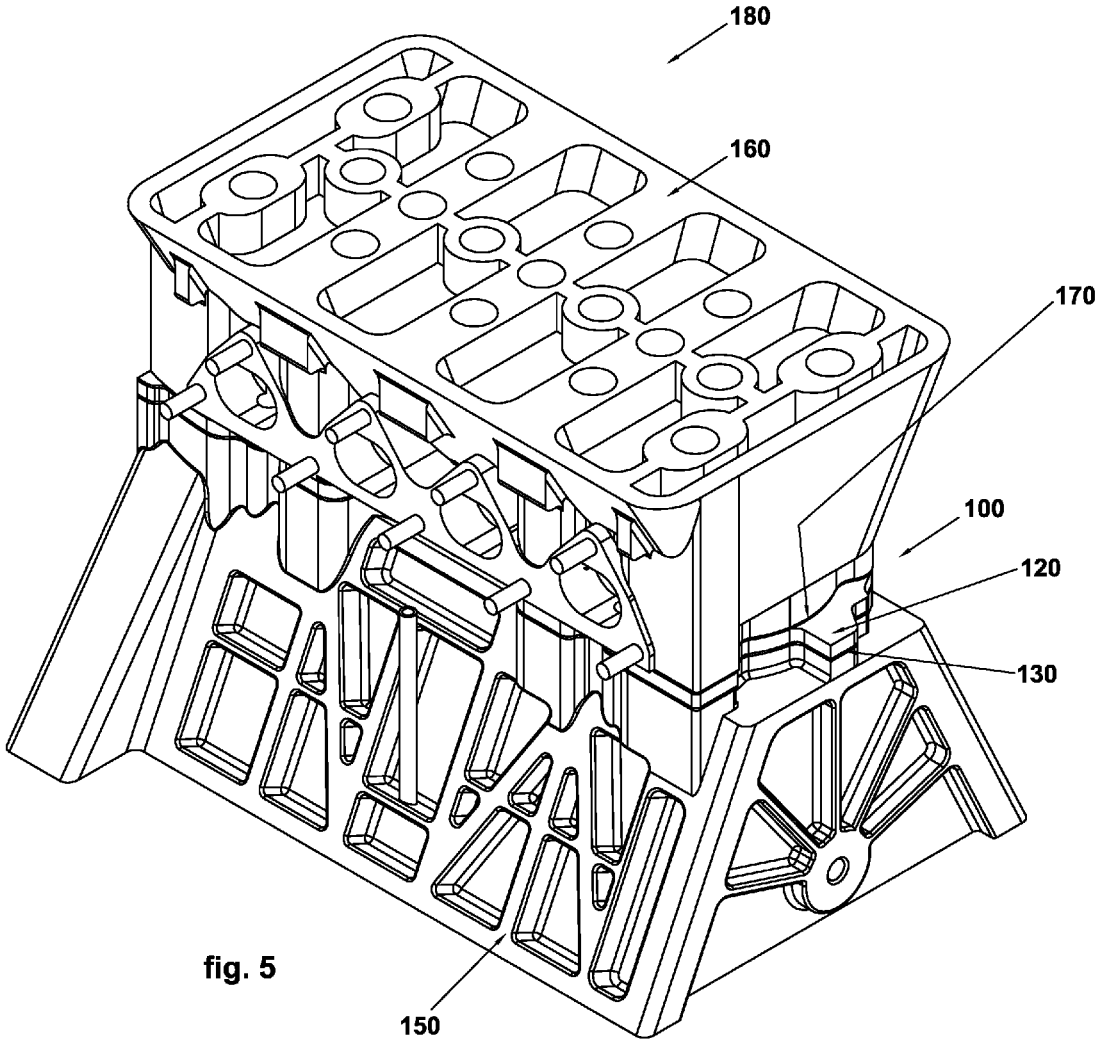
FIG. 5 is a perspective view of said engine assembled with the components illustrated in FIG. 1.

The cylinder sleeve 140 is preferably press-fitted into the bottom portion of the cylinder-can wall 152 of the cylinder bore 155. The upper portion of the wall 152, which defines a portion of the step 151, abuts against the lower surface 145 of the upper portion 144 of the sleeve, while a small vertical gap 149 is created between the lower surface 147 of the sleeve and the engine block 150. The small gap 149 between lower surface 147 of the sleeve and the engine block 150 enables reliable, consistent engagement of the lower surface of the sleeve upper portion 144 with the step 151 of the cylinder-can wall. The gap 149 additionally accommodates thermal expansion and contraction of the cylinder sleeve 140 and the upper portion of block 150, thereby avoiding, or at least minimizing, interference between the lower surface 147 of the sleeve and the engine block 150 (FIG. 4). However, in other embodiments of the invention, the gap 149 may be eliminated if so desired.

Since the cylinder-can wall 152 may be relatively thin, the wall 152 may buckle when the engine is assembled and when the wall 152 is axially compressed. To avoid buckling, the wall 152 may be secured to the cylinder sleeve 140 via a fastening compound, such as, for example, a glue, epoxy, cement, molten metal, or other material that would occur to one of skill in the art.

A lower gasket 130 is mounted on the top of engine block 150. The lower gasket 130 may contain numerous openings 135 to accommodate the flow of lubricating fluids, cooling fluids and/or the passage of mounting hardware utilized to hold the engine assembly together. The lower gasket 130 provides the sealing between the sleeve support plate 100 and the engine block 150 while allowing limited relative vertical movement therebetween. The lower gasket 130 includes raised embossment portions (such as known in the art, so not depicted in the drawings) around the various openings 135 to contain fluid within such passageways as formed by openings 156, 135 and 125. The lower gasket 130 may be formed of various materials, such as, for example, stainless steel, stainless spring steel, steel coated with materials such as silicone, wood fiber products, metal, plastic, rubber, or other materials that would occur to one of skill in the art.

The sleeve support plate 100, according to the illustrated embodiment of the invention, is placed over the lower gasket 130. The base portion 120 is mounted on top of the lower gasket 130, with the extended boss portions 110 of the plate abutting the inner edge of the generally elongated central opening in the lower gasket 130 (FIG. 4) and the inner edge of the portion of the engine block 150 adjacent step portion 151. Typically, the extended boss portions 110 are press-fitted to the inner edge portions of the engine block 150 adjacent to the step portions 151, although other embodiments do not use a press-fit. One example method for achieving the press-fit, sometimes referred to as shrink-fitting, is to heat the engine block prior to mounting support plate 100 on lower gasket 130 and engine block 150. Cooling fluid may be circulated about the cylinder-can wall 152 to provide cooling to the cylinder sleeve 140. A small gap may exist between the boss 110 and the step portion 151 to allow thermal vertical expansion and contraction of the plate 100 and the boss 110 without the boss 110 actually touching the step portion 151. Openings 115 defined through the boss portion 110 of the sleeve support plate 100 and openings 125 defined through the base portion 120 of the plate 100 (FIG. 3) accommodate the flow of lubricating fluids, cooling fluids and/or the passage of mounting hardware. The openings 115 and 125 may be formed by a drilling operation and/or during the process of casting the sleeve support plate 100.

The outer shape of the base portion 120 of the plate 100 preferably corresponds to the shape of the outer portion of the engine block 150 to which sleeve support plate 100 mounts. However, other shapes and configurations of the base portion 120 are also contemplated as falling within the scope of the present invention.

The boss portion 110 has an inner perimeter surface 112 having a profile to fit snugly against the upper portion 144 of the sleeves when the engine is assembled. The inner surface 112 laterally supports the upper portion 144 of the sleeves, thereby providing the sleeve portions 144 with such support around a substantial portion of their circumferences to prevent excessive wear and degradation, including cracking and deformation, and this prevents progression of such wear and tear to lower portions 146 of the sleeves.

The placement of numerous openings 115 in the plate 100 near upper portion 144 of the sleeve aids in cooling the upper portion 144 of the sleeve and the cylinder sleeve 140. Additionally, the material comprising the plate 100 may facilitate cooling of the cylinder sleeve 140 provided that a good heat conducting material is utilized, such as, for example, an aluminum material. In one embodiment, the plate 100 is made of a material that has a coefficient of thermal expansion greater than the coefficient of thermal expansion of the cylinder sleeve. Example materials are 7075-T6 aluminum alloy with a coefficient of thermal expansion of 247 for the sleeve support plate 100 and ductile iron with a coefficient of thermal expansion of 36 for the cylinder sleeve 140.

An upper head gasket 170 may be positioned above the plate 100. The head gasket 170 may contain numerous openings 175 to accommodate the flow of, for example, lubricant, cooling fluid and/or the passage of mounting hardware utilized to hold the assembled engine together. The head gasket 170 functions to seal potential gaps between the engine head 160, the plate 100, and the cylinder sleeve 140. The head gasket 170 may be formed of various materials, such as, for example, stainless steel, or other materials that would occur to one of skill in the art. An example head gasket 170 is an off-the-shelf multi-layer steel (MLS) gasket manufactured by Cometic Gasket, Inc., part number C4231HP. The portion of the C4231HP head gasket mounted between the plate 100 and the engine head 160 includes an inner layer of stainless spring steel sandwiched between two layers of steel where the two layers of steel are coated with silicone. The inner stainless spring steel layer includes raised embossment portions near openings 175 to help contain fluid within the passageway formed by openings 125, 175 and openings in engine head 160 aligned with openings 125 and 175. The portion of the C4231HP head gasket which is between the cylinder sleeve 140 and the engine head 160 is comprised of similar stainless steel material, but does not contain an inner layer of stainless spring steel.

The engine head 160 is positioned above the head gasket 170 and contains openings in a lower surface thereof (not depicted) to be aligned with the openings 115, 125, 135, 156 and 175 to facilitate the flow of cooling fluid between various engine components and to provide passages through which mounting hardware may be placed to secure the engine together. Additionally, the head may include valves, pushrods, fluid passages and camshafts as necessary.

The stresses inflicted upon cylinder sleeves in internal combustion engines are typically increased when the replacement cylinder sleeves 140 are longer than the cylinder bores 155 formed in the original engine block 150, such that the upper portions of the cylinder sleeves 140 extend above the top of engine block 150. While the longer cylinder sleeves have the advantage of increasing the available displacement of the combustion chamber, the additional stresses imposed on the upper portions of conventional cylinder sleeves that extend above the engine block may cause such cylinder sleeves to overheat and wear at an increased rate. The present invention provides an improved structure by reinforcing and supporting the cylinder sleeves of the internal combustion engine, particularly with regard to cylinder sleeves that extend above the engine block.

One consideration in internal combustion engines is to maintain compression of the upper gasket 170 between the cylinder sleeve 140 and the engine head 160. During operation of the engine, the plate 100 may tend to move slightly in a direction away from the engine head 160 or the engine block 150. The fit of the plate boss surface 112 to the upper portion 144 of the cylinder sleeve is a slight interference fit. For example, the inner diameter of the curves of surface 112 equals the outer diameter of the sleeve portions 144. Therefore, while the fit is snug, it is not rigid, so it does allow the cylinder sleeve 140 and the plate 100 to move independently of each other slightly in the vertical direction during engine operation. So it facilitates maintaining compression and sealing of the head gasket 170 between the cylinder sleeve 140 and the engine head 160, even if the plate 100 moves slightly in the vertical direction relative to the head and/or block.

Because of the larger area of plate 100 than that of sleeve top surfaces, it is conceivable that under some conditions, such as the thermal vertical expansion of the block 150 exceeding that of the sleeves 140, plate 100 may exert a greater total force on the upper gasket 170 than the force exerted by the cylinder sleeves 140, thereby causing a relaxation of the pressure between the cylinder sleeve 140 and the upper gasket 170 and attendant potential escape of gases from between the cylinder sleeve 140 and upper gasket 170. However, the placement of the compressible lower gasket 130 between the engine plate 100 and the engine block 150 results in the plate 100 exerting less force on the upper gasket 170 than the cylinder sleeves 140 under normal conditions. The compressible lower gasket 130 also allows the plate 100 to move slightly in relation to the engine block 150, thereby further enabling the plate 100 and the sleeve 140 to move independently in the vertical direction.

It is preferable that the lower gasket 130 is configured and arranged such that the top of plate 100 will be positioned slightly below the top of the cylinder sleeve 140 by about 0.002 inches when the lower gasket 130 is fully compressed during operation of the assembled engine 180. Thus, the head-to-gasket compression at the head-to-sleeve-top location will be adequate to seal the combustion chamber's high pressure, while the head-to-plate and plate-to-block compression remains adequate to seal lubricating and cooling fluids.

The engine head 160, the upper gasket 170, the sleeve support plate 100, the lower gasket 130 and the engine block 150 may be sequentially mounted together using mounting hardware to assemble the engine 180. Various types of hardware (not depicted) may be utilized to hold the respective parts and components of engine 180 together, including, for example, bolts, screws, clips and clamps.

Figure 6:
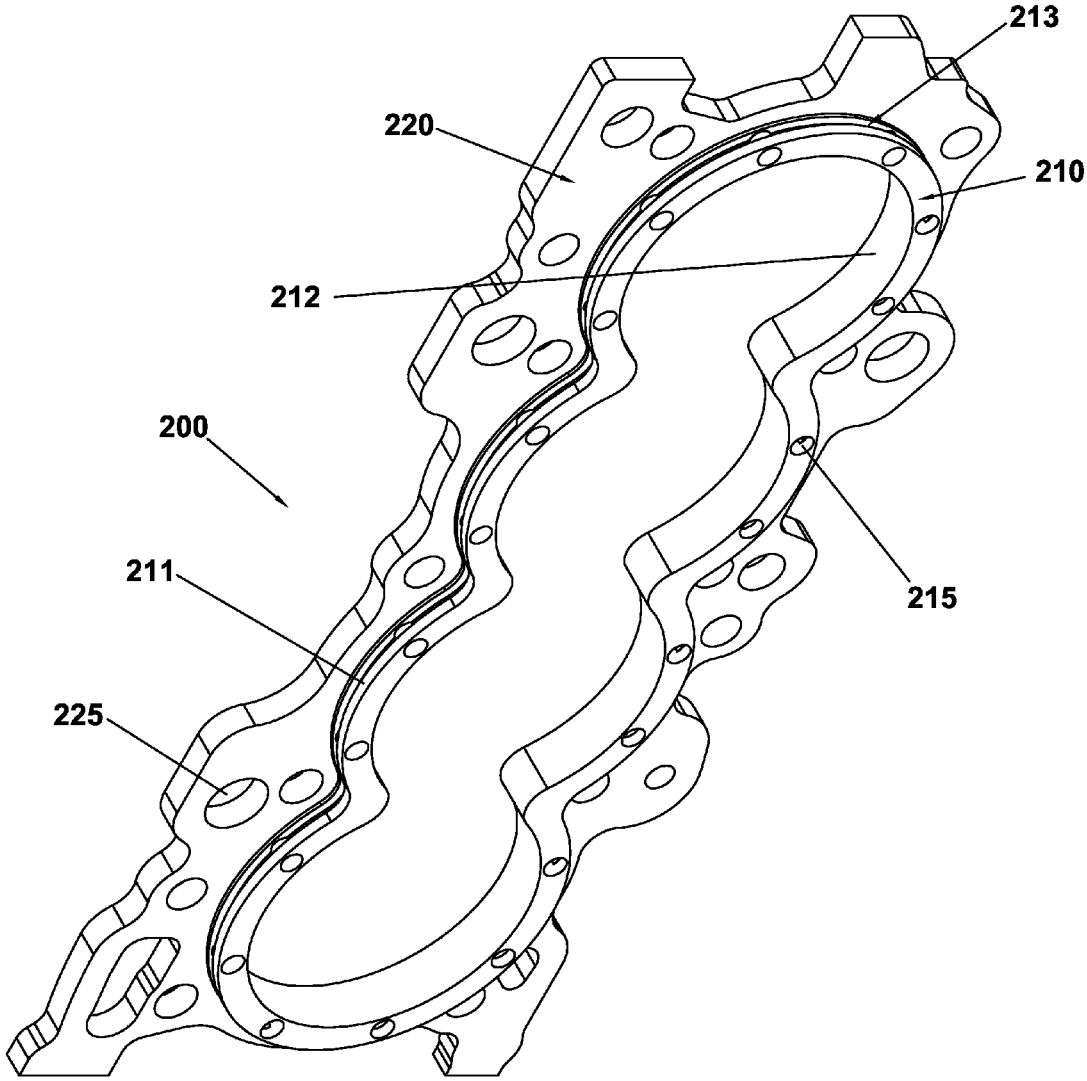
FIG. 6 is a bottom perspective view of a cylinder sleeve support plate according to another embodiment of the present invention.
Figure 7:
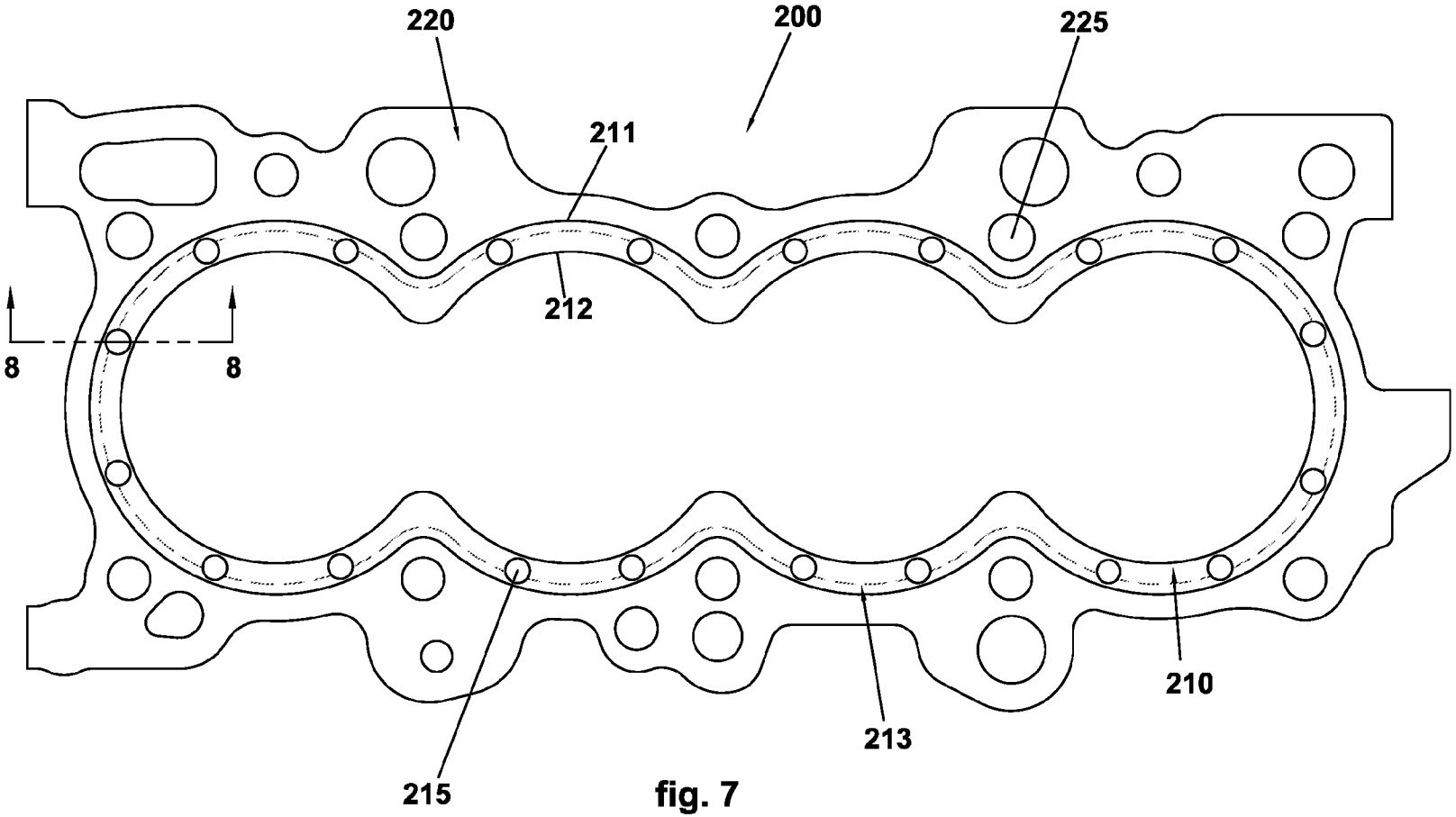
FIG. 7 is a bottom plan view of the cylinder sleeve support plate illustrated in FIG. 6.
Figure 8:
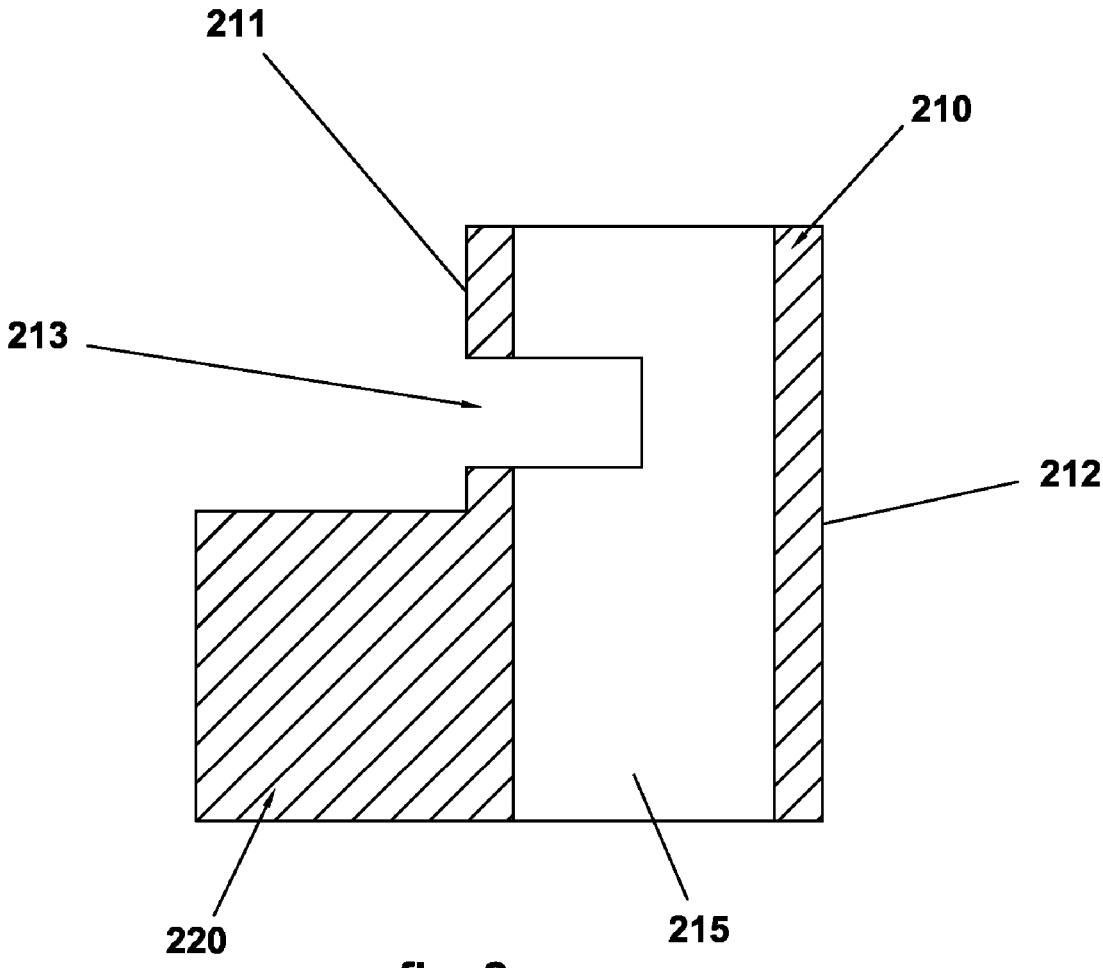
FIG. 8 is a cross-sectional view of a portion of the cylinder sleeve support plate illustrated in FIG. 7, taken along line 8-8 of FIG. 7.

Referring to FIGS. 6-8, shown therein is a cylinder support plate 200 according to another embodiment of the present invention. In many ways, the plate 200 is similar to that of the plate 100 illustrated and described above. The plate 200 includes an extended boss portion 210 and a base portion 220. The boss portion 210 defines openings 215 and the base portion 220 defines openings 225 through which lubricating and cooling fluids may flow or mounting hardware may be placed. The boss portion 210 has a recessed groove portion 213, or channel, cut into the outer surface 211 to allow cooling fluid movement in a generally horizontal direction when the plate 200 is assembled with an operating engine. The groove 213 communicates with, and preferably intersects, the openings 215 in the boss portion 210. Allowing horizontal fluid movement through groove 213, in addition to the vertical cooling fluid movement through the openings 215, enhances the ability of the plate 200 to transport heat away from inner surface 212 and the cylinder sleeve. Although not depicted in the figures, it is also contemplated that the groove 213 may be cut into the inner surface 212 or may comprise a hollow tube enclosed within the boss portion 210.

Referring now to FIGS. 9-19, there are select components of an internal combustion engine including a cylinder sleeve support plate 300 according to still another embodiment of the present invention. It should be noted that cylinder sleeve support plate 300 is shown used in conjunction with an open deck type internal combustion engine, although it may also be used with closed deck type engines. The open deck engine blocks may be originally cast as open deck type engine, or may be converted to open deck type configurations after the original casting.

Figure 17:
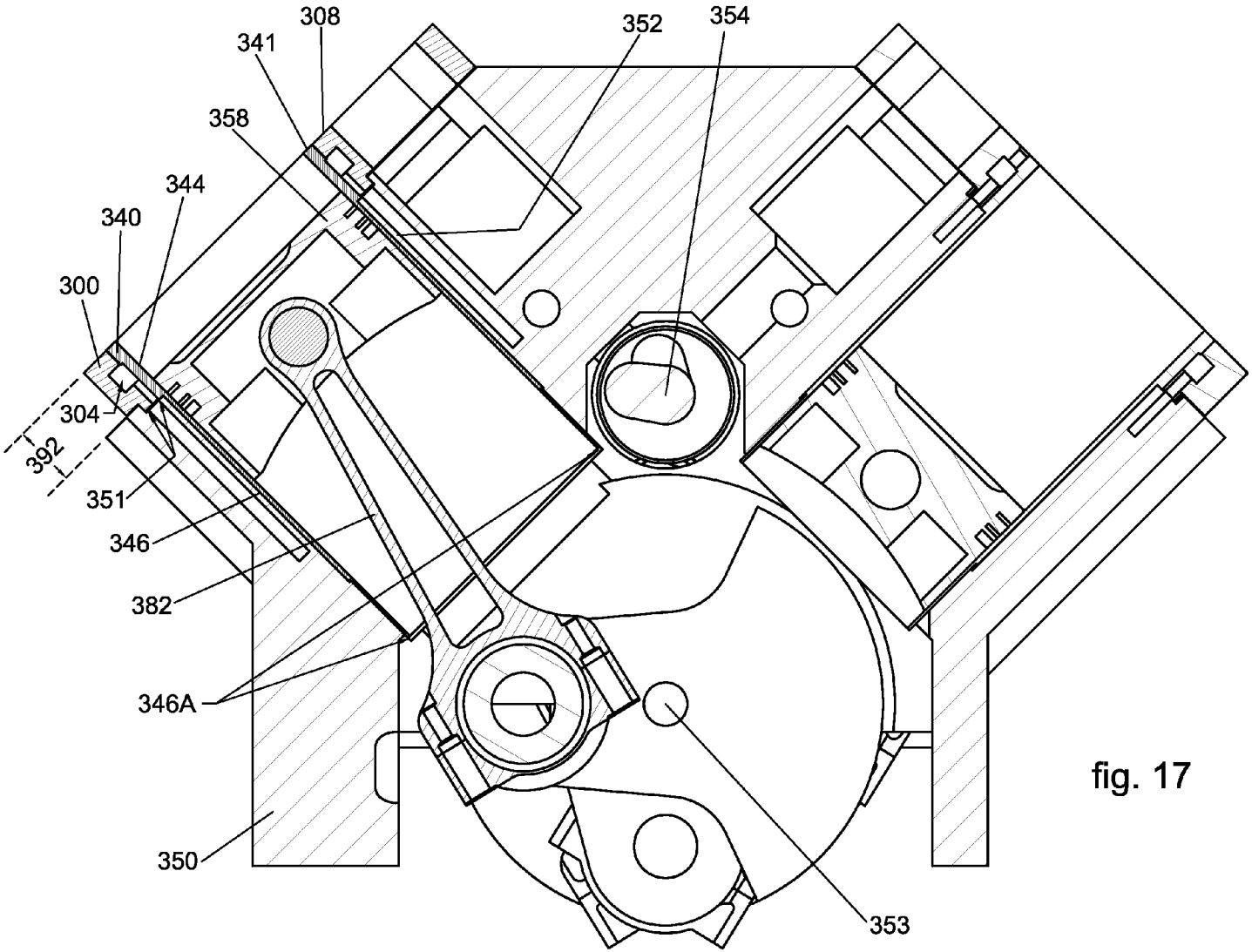
FIG. 17 is a cross-sectional view of a portion of the assembled engine components illustrated in FIG. 16, taken along line 17-17 of FIG. 16.

The engine block 350 has eight cylinder bores into which respective cylinder sleeves 340 are placed. In the illustrated embodiment, the eight cylinder bores are arranged in a two-bank V-type configuration that is typically referred to as a "V-8" engine block. It should be appreciated that other embodiments may include any number of cylinders in various cylinder arrangements such as are known in the art, the specific number and arrangement of cylinders not being a limiting feature of the present invention. The bores may be formed by drilling or boring out all or portions of the original cylinder sleeves. Portions of the cylinder bores in block 350 may also be drilled or bored out. Each individual bore may have an individual and separate cylinder sleeve 340 positioned therein, or multiple cylinder bores may have an array of interengaging cylinder sleeves 340 positioned therein. Referring to FIG. 17, the cylinder sleeve 340 has lower portion 346 and upper portion 344. It should be understood that the length of the cylinder sleeve 340 may be greater than, equal to, or less than the depth of the cylinder bore.

Referring now to FIGS. 10-13, the cylinder sleeve support plate 300 includes an inner perimeter support portion 301, a base portion 320 and an annular boss portion 310. The inner perimeter support portion 301 includes an inner perimeter upper surface 302, a groove 304, and an inner perimeter lower surface 306. The annular boss portion 310 includes an annular boss outer surface 311 and an inner surface, where the inner surface is also at least a portion of the inner perimeter lower surface 306.

Figure 18:
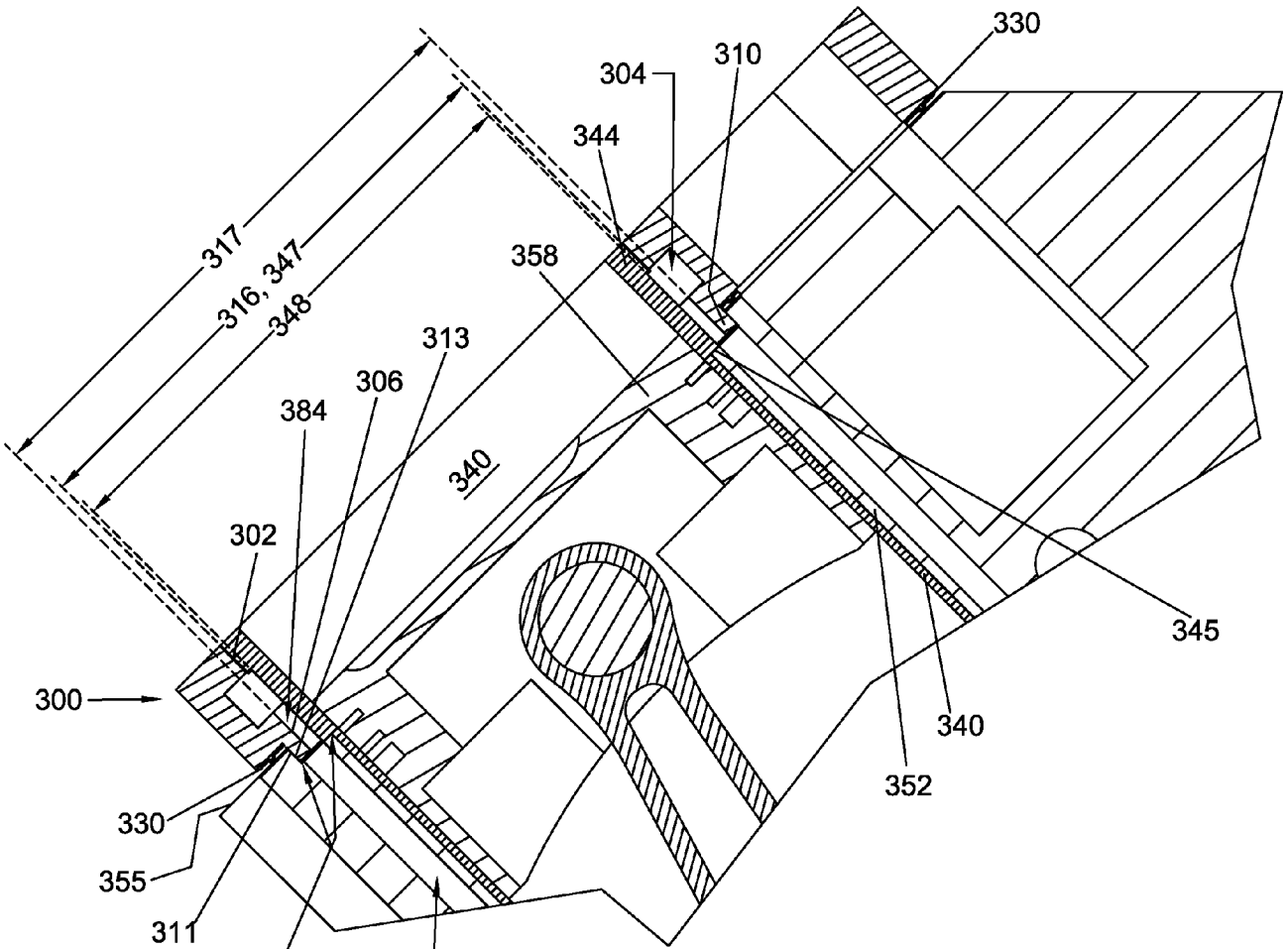
FIG. 18 is an enlarged view of a portion of the assembled engine components illustrated in FIG. 17.

In the illustrated embodiment, as shown in FIGS. 17 and 18, modification of the engine block 350 includes boring out the original cylinder sleeves and/or the cylinder bores, and counter-boring the top of the cylinder bore to provide an annular step or ridge 351 in the upper portion of the cylinder bore. The upper portion 344 of the sleeve 340 and an annular boss portion 310 defined by the plate 300 are received at step 351. With the replacement sleeve 340 press-fitted into the cylinder bore, the plate 300 is then installed with an inner perimeter upper surface portion 302 of an inner perimeter support portion 301 of plate 300 preferably fitting snugly against the upper portion 344 of the cylinder sleeve 340 to laterally support the cylinder sleeve 340.

In one embodiment of the invention, the engine block 350 is cast as a closed block and the upper surface of the engine block 350 is machined or cut down, converting the closed block to an open block. In this manner, if desired, engine displacement may be increased beyond that of the original engine displacement by increasing the stroke and providing a longer cylinder sleeve 340 such that the upper portion of the cylinder sleeve 340 extends above the upper surface of the engine block 350.

The engine block 350 may be manufactured from various types of durable materials, such as, for example, steel, iron, aluminum or heat resistant plastics, although other materials with similar properties may also be utilized. In one embodiment of the invention, the cylinder sleeve 340 is formed of a durable, heat resistant material, such as, for example, various types of irons, including ductile and cast iron, various types of steels, including chrome alloy steel, or certain types of ceramics. However, other suitable materials may also be utilized. Additionally, the cylinder sleeve 340 may be formed of more than one material, such as, for example, a metal alloy material or a metal coated with a ceramic material.

Figure 19:
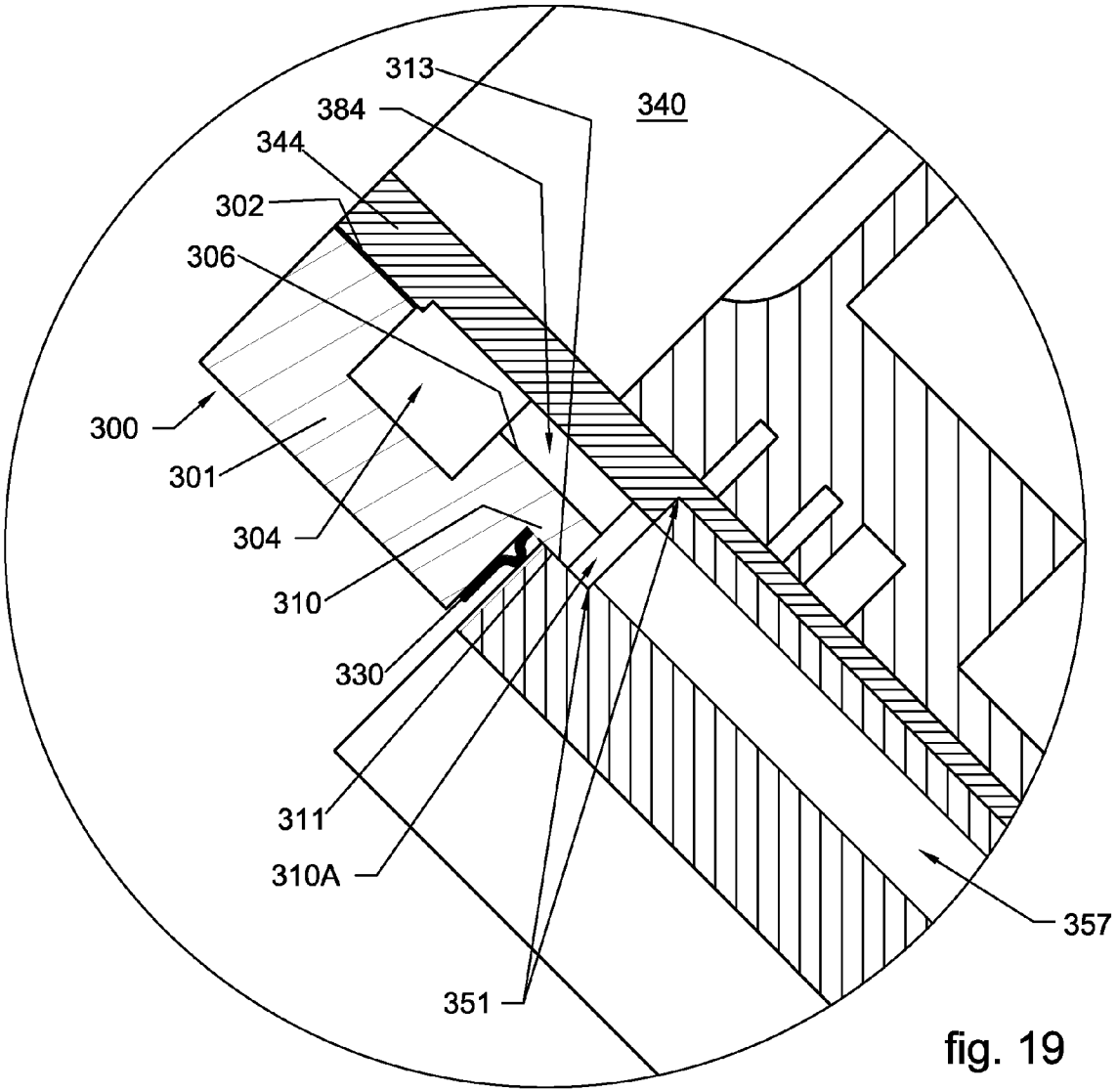
FIG. 19 is an enlarged view of a portion of the assembled engine components illustrated in FIGS. 17 and 18.
Figure 20:
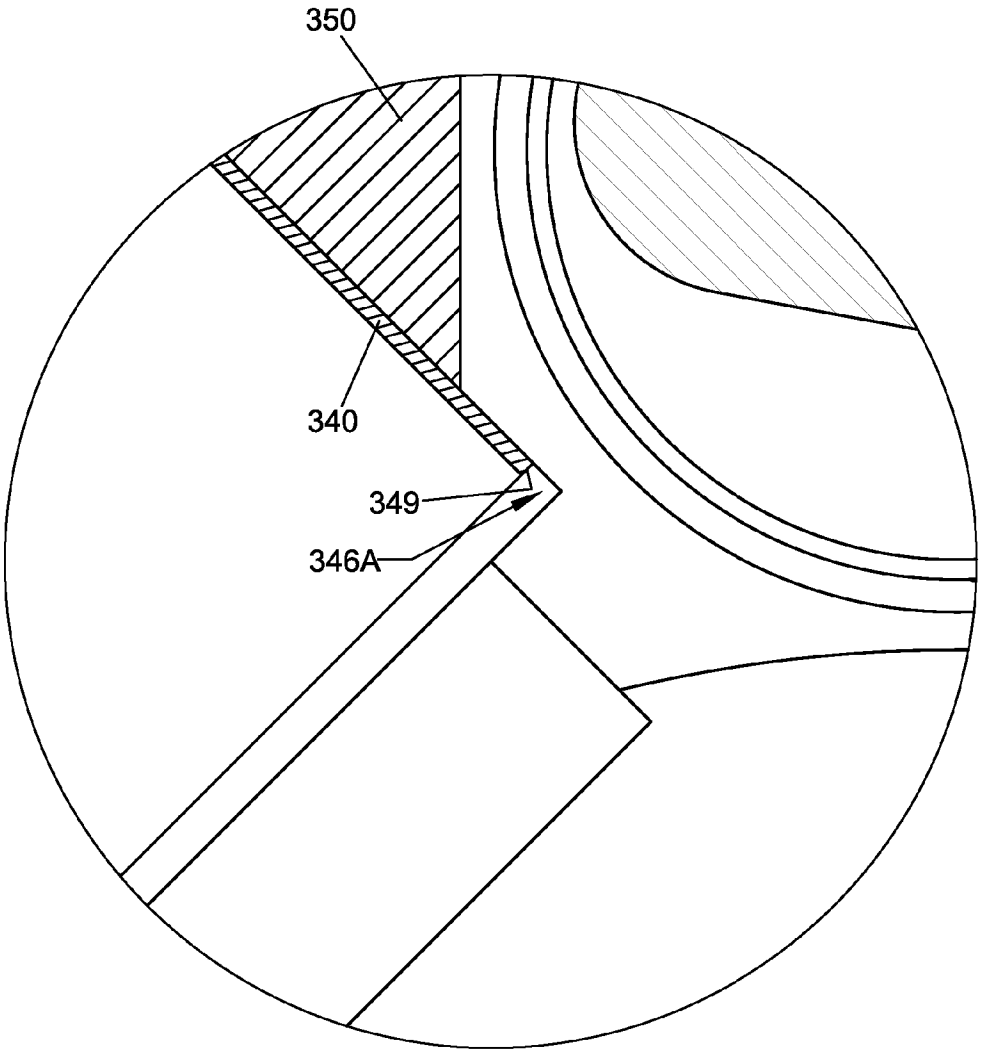
FIG. 20 is an enlarged view of another portion of the assembled engine components illustrated in FIG. 17.

In reference to FIGS. 17-20, particularly FIG. 20, the cylinder sleeve 340 is preferably press-fitted into the bottom portion of the cylinder-can wall 352. The upper portion of the wall 352, which defines at least a portion of the step 351, abuts against the lower surface 345 (FIG. 18) of the upper portion 344 of the sleeve 340, while a small vertical gap 346A is created between the lower end 349 of the sleeve and the engine block 350. The gap 346A (FIG. 20) between lower end 349 of the sleeve and the engine block 350 enables reliable, consistent engagement of the lower surface 345 of the sleeve upper portion 344 with the step 351. The gap additionally accommodates thermal expansion and contraction of the cylinder sleeve 340 and the upper portion of block 350, thereby avoiding interference between the lower end 349 of the sleeve and the engine block 350. However, in other embodiments of the invention, the gap may be eliminated if so desired.

Since the cylinder can wall 352 may be relatively thin, the wall 352 may buckle when the engine is assembled and when the wall 352 is axially compressed. To avoid buckling, the cylinder can 352 may be secured to the cylinder sleeve 340 via a fastening compound, such as, for example, a glue, epoxy, cement, molten metal, or other material that would enhance the integrity of the can 352 and the sleeve 340 and help seal potential leaks. Typically, to install cylinder sleeve 340, engine block 350 is heated and cylinder sleeve 340 is inserted into the cylinder can wall 352 using a slip-fit until the last approximately one (1) inch of travel where there is a light press-fit or an interference fit between the bottom of sleeve 340 and the bottom of cylinder can wall 352. Once the engine block 350 cools, a full press-fit is formed between the bottom of sleeve 340 and the bottom of cylinder can wall 352. Other methods of installing cylinder sleeve 340 can be used provided that sufficient securement to block 350 is achieved.

Referring now to FIGS. 9 and 14-18, a lower gasket 330 is mounted on the top of engine block 350. The lower gasket 330 may contain numerous openings to accommodate the flow of lubricating fluids, cooling fluids and/or the passage of mounting hardware utilized to hold the engine assembly together. The lower gasket 330 provides the sealing between the cylinder sleeve support plate 300 and the engine block 350 while allowing limited relative vertical movement therebetween. The lower gasket 330 includes raised embossment portions around the various openings which register with fluid passageway openings in the plate 300 and in the engine block 350 to contain fluid within such passageways as formed by openings 356, 335 and 325. The lower gasket 330 may be formed of various materials, such as, for example, stainless steel, stainless spring steel, steel coated with materials such as silicone, wood fiber products, metal, plastic, rubber, or other combinations of materials that would preferably provide the desired compressability and sealing described herein.

Figure 10:
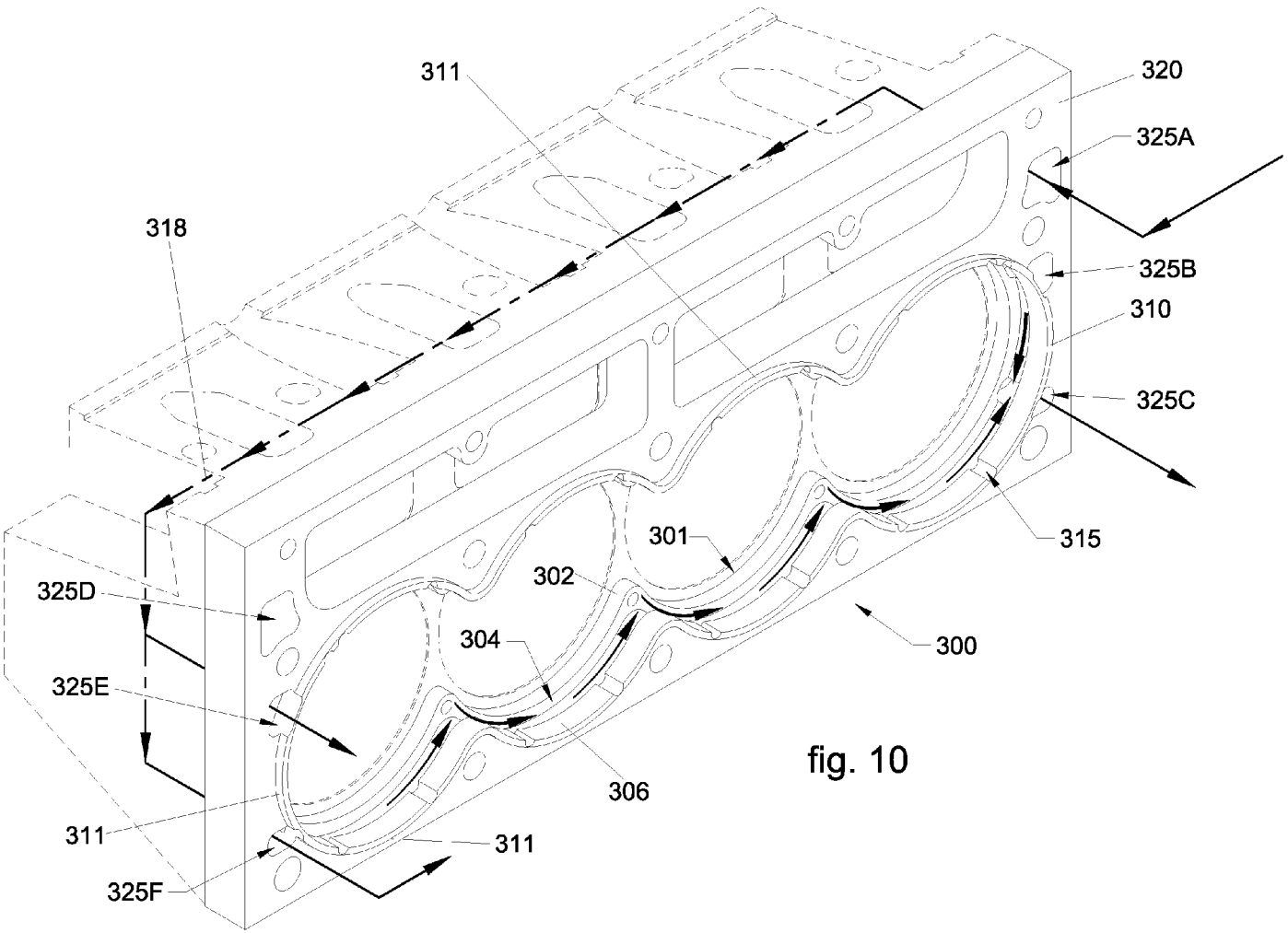
FIG. 10 is a bottom perspective view of the cylinder sleeve support plate illustrated in FIG. 9.
Figure 11:
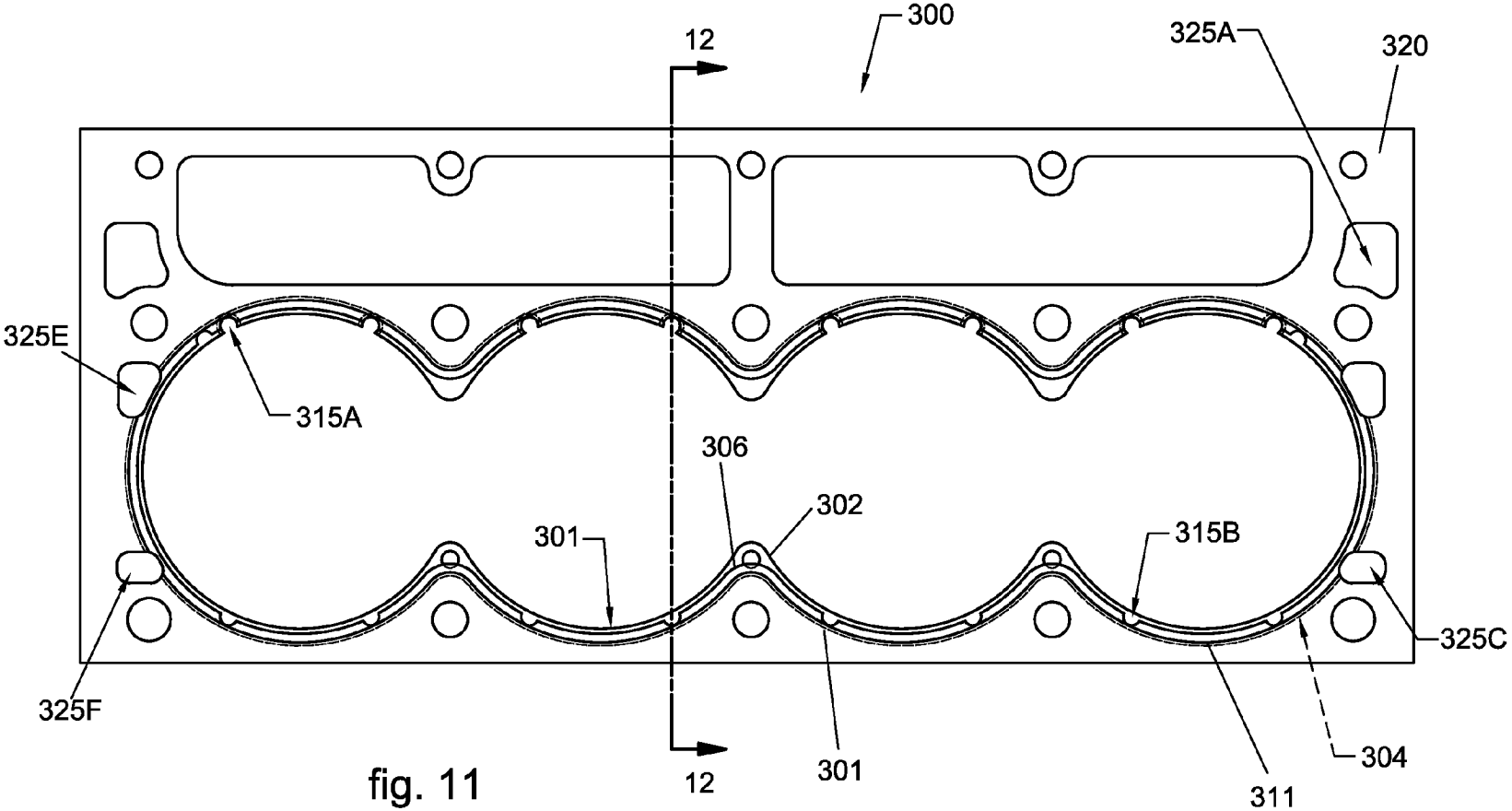
FIG. 11 is a bottom plan view of the cylinder sleeve support plate illustrated in FIG. 9.

Referring to FIGS. 10 and 18, the sleeve support plate 300, according to the illustrated embodiment of the invention, is mounted to block 350 and placed over the lower gasket 330. The bottom face portion, or base portion 320 (FIG. 10), is mounted on top of the lower gasket 330, with the annular boss or flange outer surface 311 of the plate abutting the inner edge of the generally elongated central opening in the lower gasket 330. Cooling fluid is circulated in engine block space 357 about the cylinder-can wall 352 and in groove 304 of the plate 300 to provide cooling to the cylinder sleeve 340.

Referring to FIGS. 18 and 19, a small vertical gap 310A may exist between the boss 310 and the step portion 351. Vertical gap 310A allows thermal vertical expansion and contraction of the plate 300 and the boss 310 without the boss 310 actually touching the step portion 351. This feature can be helpful in minimizing the upward force exerted by plate 300 on head gasket 370, allowing plate 300 to move and/or thermally expand vertically relative to sleeve 340, and avoid the ability of plate 300 to lift head gasket 370 off the cylinder sleeves 340. Alternate embodiments might not include a gap 310A if, for example, the vertical forces of thermal expansion at the abutting engagement of the step portion 351 with the boss 310 is relatively small.

Openings 315 (which are defined through the inner perimeter support portion 301 of the sleeve support plate 300) and openings 325 (which are defined through the base portion 320 of the plate 300 (FIG. 10) and include openings 325A, 325B, 325C, 325D, 325E and 325F) accommodate the flow of lubricating fluids and cooling fluids. Other openings accommodate the passage of mounting hardware such as bolts or studs. The openings 315 and 325 may be formed, for example, by a drilling operation and/or during the process of casting the sleeve support plate 300.

The outer shape of the base portion 320 of the plate 300 preferably corresponds generally to the shape of the outer portion of the engine block 350 to which sleeve support plate 300 is mounted. However, some differences may be accommodated for convenience if desired.

Referring further to FIG. 18, a press-fit exists between the annular boss outer surface 311 and the substantially vertical boss receiving surface 313 of the engine block 350 extending downward from the top surface 355 of the engine block 350. The press-fitting of the annular boss outer surface 311 to the engine block 350 helps anchor the support plate 300 to the engine block 350 and helps laterally support the sleeve 340 by, at least in part, reducing the lateral movement between the two. This reduction of lateral movement between the support plate 300 and the engine block 350 helps minimize the lateral movement of the cylinder sleeve upper portion 344 with respect to the engine block 350. Minimizing the lateral motion between the cylinder sleeve upper portion 344 and the engine block 350 is useful for preventing deformation of the cylinder sleeve 340, which otherwise could result in increased friction between the piston 358 and the cylinder sleeve 340 with attendant, increased wear, loss of power, and potential engine failure or seizure.

One method used to achieve a press-fit between the annular boss outer surface 311 and the surface 313 is to heat the engine block 350 while maintaining the support plate 300 at a lower temperature when the support plate 300 is mounted onto the engine block 350. When the engine block 350 cools it contracts and increases the contraction block pressure exerted on the annular boss outer surface 311.

Referring to FIG. 10 along with 18 and 19, the inner perimeter support portion 301 defines a portion of plate 300 that is adjacent to the cylinder sleeves 340 when the engine is assembled and includes inner perimeter upper surface 302 and inner perimeter lower surface 306. The area described and surrounded by inner perimeter upper surface 302 is smaller than the area described and surrounded by inner perimeter lower surface 306. As stated in a different manner, the characteristic diameter 316 of inner perimeter upper surface 302 is smaller than the characteristic diameter 317 of inner perimeter lower surface 306. See FIG. 18. In alternative embodiments if a greater area of lateral support on the sleeve is desired, the characteristic diameter 316 of inner perimeter upper surface 302 may be equal to or greater than the characteristic diameter 317 of inner perimeter lower surface 306.

The inner perimeter upper surface 302 has a profile to fit snugly against the upper portion 344 of the sleeves 340 when the engine is assembled. The inner perimeter upper surface 302 laterally supports the upper portion 344 of the sleeves 340, thereby providing the sleeve portions 344 with such support around a substantial portion of their circumferences to inhibit lateral movement or wobble of the cylinder sleeves 340. So it inhibits excessive wear and degradation, including cracking and deformation, and thus prevents progression of such wear and tear to lower portions 346 of the sleeves.

In the illustrated embodiment, the inner perimeter lower surface 306 does not contact the cylinder sleeve 340. One advantage to maintaining a gap at this location is to allow coolant to circulate over a larger region around the cylinder sleeve 340. Another advantage to maintaining such a gap is to accommodate any potential misalignment or tolerance stack-up that occurs during assembly. However, for other reasons, such as increased support for cylinder sleeve 340, in alternate embodiments the diameter 317 of inner perimeter lower surface 306 may be about the same as the diameter 316 of inner perimeter upper surface 302 and may contact the cylinder sleeve 340 when installed.

Below the region where the inner perimeter upper surface 302 contacts the cylinder sleeve upper portion 344 is a region where the groove 304 circulates coolant around and in contact with the cylinder sleeve upper portion 344. This type of configuration has benefits when the cylinder sleeve 340 extends a relatively large distance above the engine block 350 since the highest amount of heat and pressure is typically generated in the region around the top of the cylinder sleeve 340. In embodiments where the cylinder sleeve does not extend above the engine block or extends above the engine block a short distance, the additional cooling provided by the groove 304 may not be required, or there may be insufficient structure in support plate 300 to support a groove that would provide meaningful cooling. As an example, in one embodiment represented by FIGS. 17, 18 and 19, the cylinder sleeve 340 extends approximately 1 (one) inch above the step 351 of the engine block 350. In this embodiment, sufficient room exists in sleeve 340 for the groove 304, while in other embodiments there may be insufficient room in sleeve 340 for a groove the size of groove 304.

In FIG. 18, the cylinder sleeve upper portion 344 does not have a consistent outer diameter. The outer surface diameter 347 of the sleeve upper portion 344 adjacent the support plate inner perimeter upper surface 302, which is equal to characteristic diameter 316 of surface 302 in the illustrated embodiment, is slightly larger than the outer diameter 348 of the rest of cylinder sleeve upper portion 344. This difference in outer diameters of cylinder sleeve upper portion 344 helps avoid a tolerance stack-up problem during installation, by placing the tightest fit between the inner perimeter support portion 301 and cylinder sleeve upper portion 344 where inner perimeter support portion 301 and cylinder sleeve upper portion 344 meet at the top of the sleeve. Other embodiments may include a cylinder sleeve upper portion 344 with a constant outer diameter, while still other embodiments of cylinder sleeve upper portion 344 could include three or more regions with outer diameters that differ from the adjacent regions.

Referring now to FIG. 10, when installed in an engine, a General Motors® LS-1 engine for example, the coolant flow pattern is as illustrated by the coolant flow direction arrows 318. The coolant flow direction arrows 318 depict coolant flowing in and through the support plate 300 and up into the engine head 360 (FIG. 9), then flowing down into and through the support plate 300, such as through the openings 325, and along the groove 304. In the illustrated embodiment, arrows 318 depict coolant flowing up from the engine block 350, through opening 325A, and into the engine head 360. Arrows 318 further depict coolant flowing down from the engine head 360 through openings 325E and 325F and into the engine block 350 with a portion of the coolant being diverted into groove 304. The coolant diverted into groove 304 flows along groove 304 and into opening 325C, where the coolant exits plate 300 and enters engine block 350.

Although no significant amount of coolant flows through openings 325B and 325C in the depicted example, openings 325B and 325C are provided and are positioned to have coolant flow through them if plate 320 is installed on the other bank of cylinders, where the coolant flow will be similar but more of a mirror image to what is depicted in FIG. 10. By providing all six openings 325, the same plate 320 may be used on either bank of cylinders. Other embodiments may use different numbers of openings, while still other embodiments contain openings 325 appropriate for only one bank of cylinders.

Openings 325E and 325F are somewhat smaller than the corresponding coolant openings 335 in the lower gasket 330 and openings 356 in the engine block 350, respectively, in order to divert coolant horizontally into the groove 304. The smaller size of openings 325E and 325F act as flow restrictors for the coolant passing through plate 300, thereby diverting some of the coolant flow into groove 304. The size and shape of openings 325 may be varied to achieve the proper cooling for each particular application/engine, and in some embodiments one or more of the openings 325 may create a gap in boss portion 310.

Figure 15:
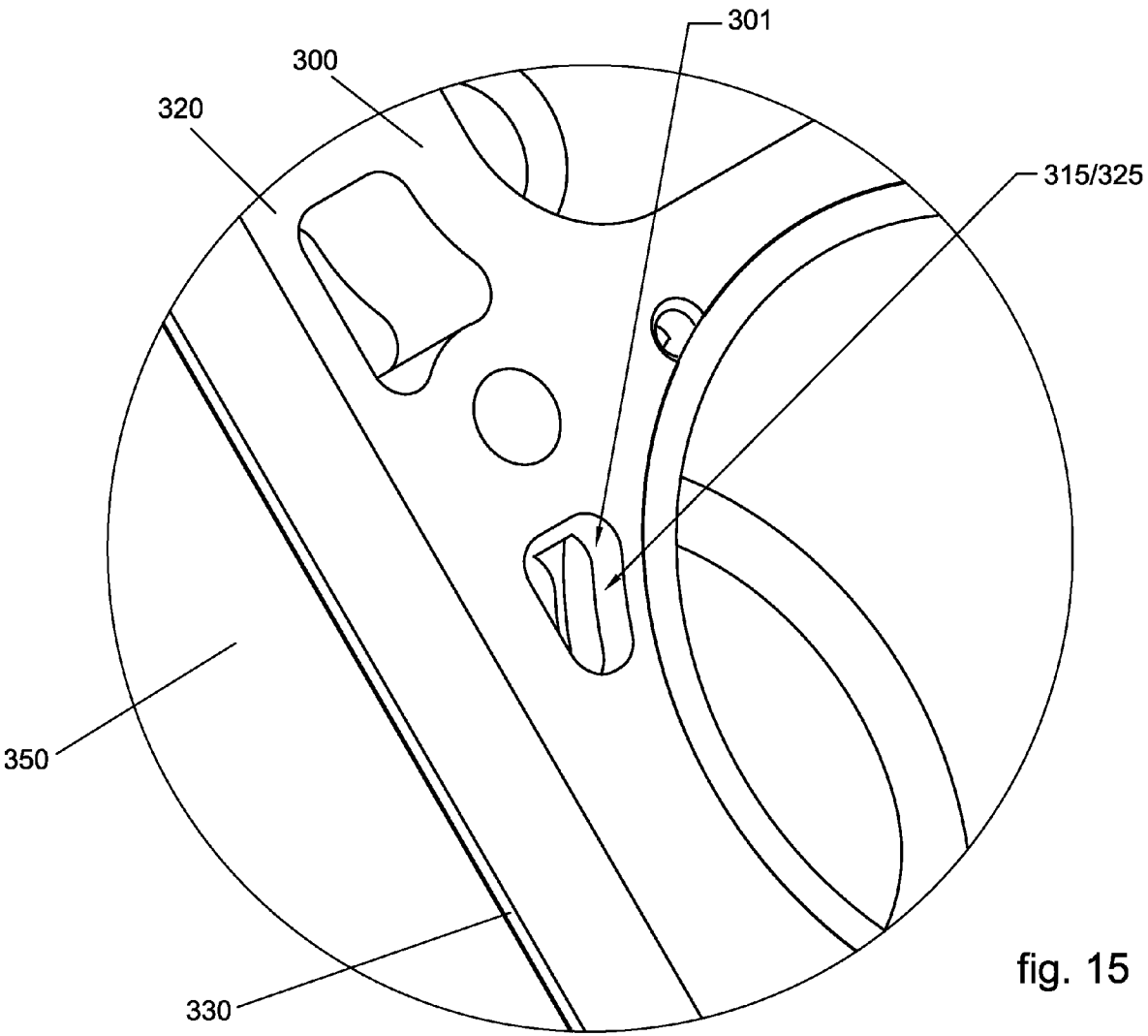
FIG. 15 is an enlarged view of a portion of the assembled engine components illustrated in FIG. 14.
Figure 16:
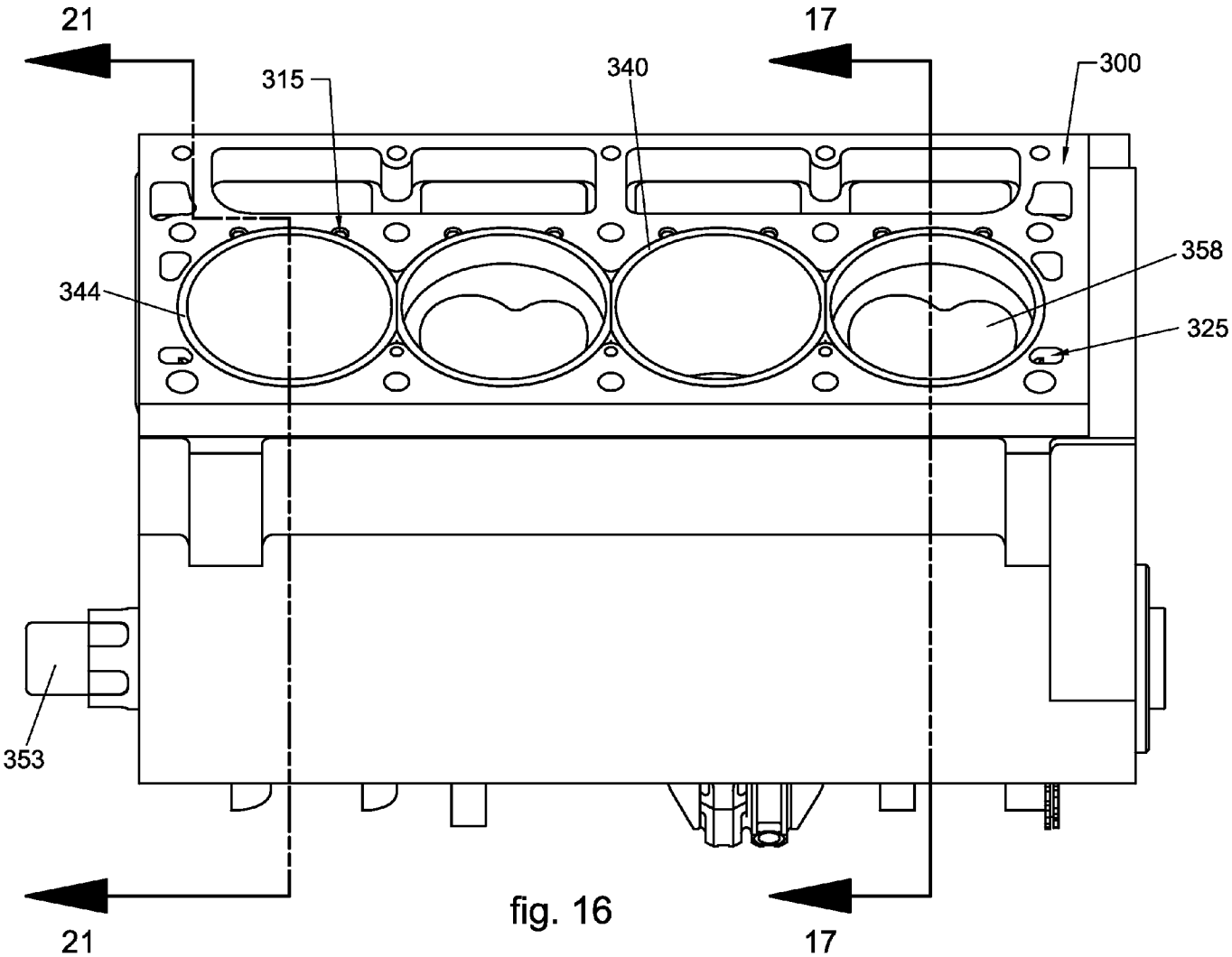
FIG. 16 is a side view of the assembled engine components illustrated in FIG. 14.

The flow of coolant along the groove 304 and directly in contact with the cylinder sleeve 340 provides direct cooling for the cylinder sleeves 340, and in particular the cylinder sleeve upper portions 344, which are typically subject to the greatest amount of heat produced in the combustion chamber. Additional coolant flow may occur through the openings 315 in the inner perimeter support portion 301. It should be understood that although the openings 315 through the inner perimeter support portion 301 and the openings 325 through the base portion 320 are discussed separately, this is not to be construed as a limitation since there are openings in the support plate 300 that pass through both the inner perimeter support portion 301 and the base portion 320. See FIG. 15 illustrating an opening that passes through both support portion 301 and base portion 320. Additionally, the direction arrows 318 are offered to be illustrative of coolant flow through portions of the support plate 300 according to one embodiment of the present invention, and are not intended to be limiting or to depict the precise flow through other engine components, such as the engine head 360 or the engine block 350. Other embodiments may utilize coolant flow patterns that differ from that which is depicted in FIG. 10.

Furthermore, it should be noted that some of the openings 315, for example openings 315A, (FIGS. 11, 12, and 13) pass through both the upper and lower portions of the of the inner perimeter support portion 301, while other openings 315, for example openings 315B, pass through only one of the upper and lower portions. In the depicted embodiment, the openings 315 through the inner perimeter upper and lower surfaces 302 and 306 are depicted as being semicircles with one portion of the opening 315 being open to expose coolant directly to the cylinder sleeve 340, although other embodiments may include openings 315 that are closed and do not expose coolant directly to the cylinder sleeve 340.

Figure 12:
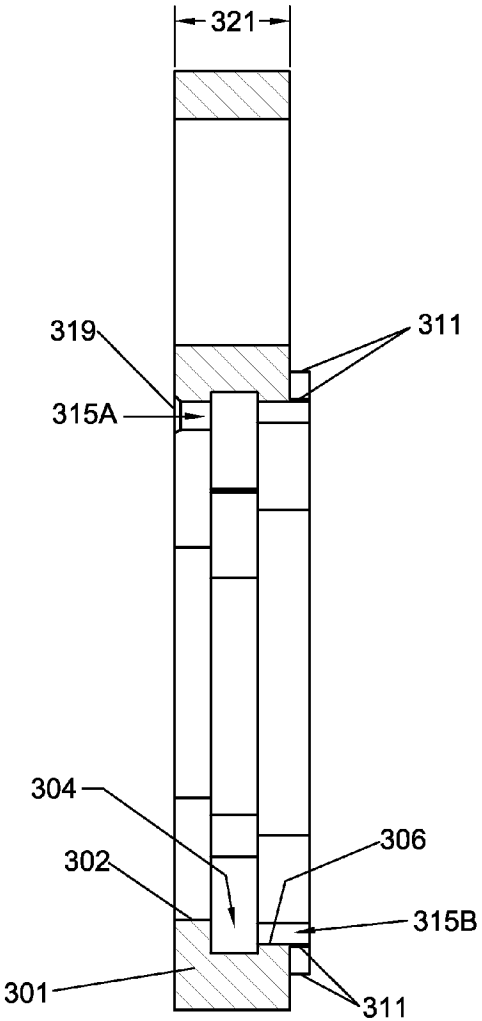
FIG. 12 is a cross-sectional view of a portion of the cylinder sleeve support plate illustrated in FIG. 11, taken along line 12-12 of FIG. 11.
Figure 13:
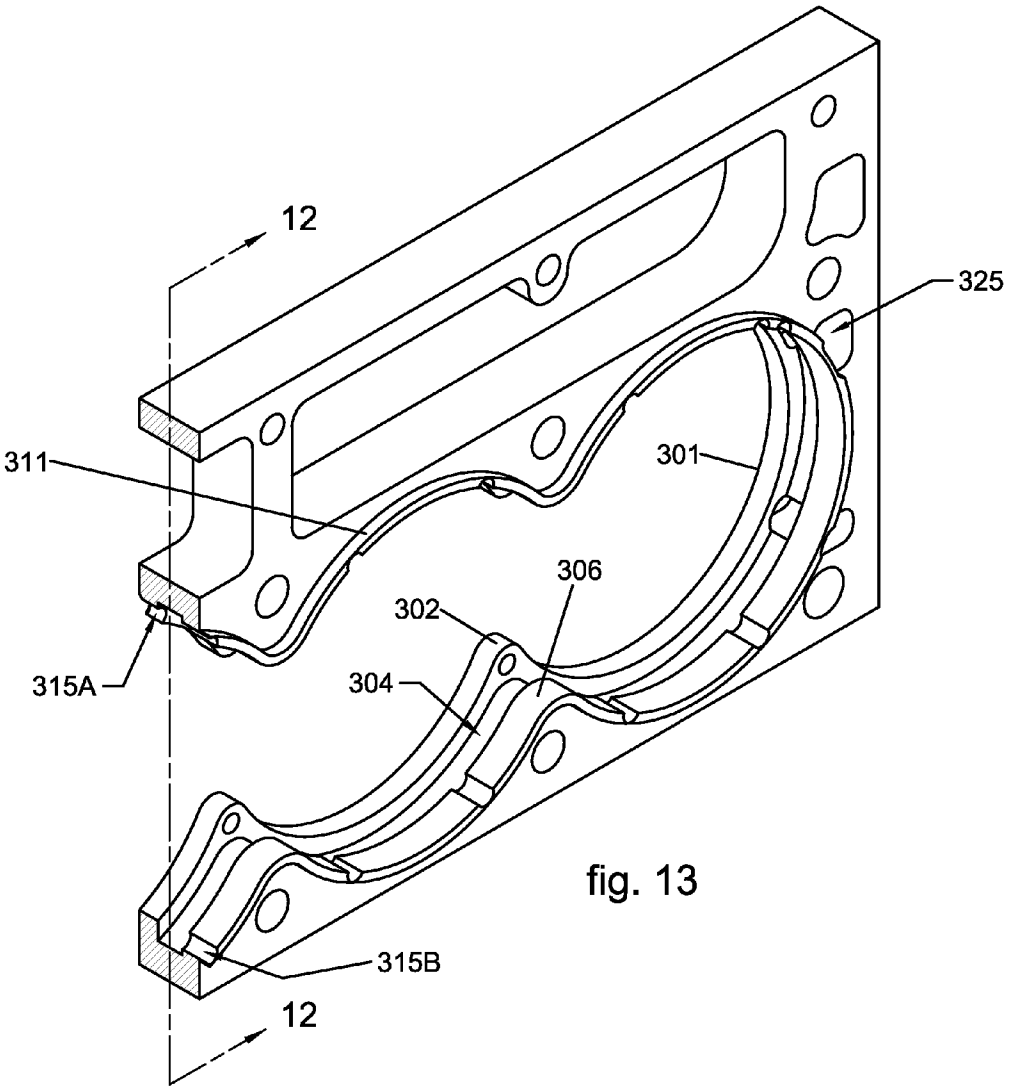
FIG. 13 is a perspective view of the portion of the cylinder sleeve support plate illustrated in FIG. 12.
Figure 14:
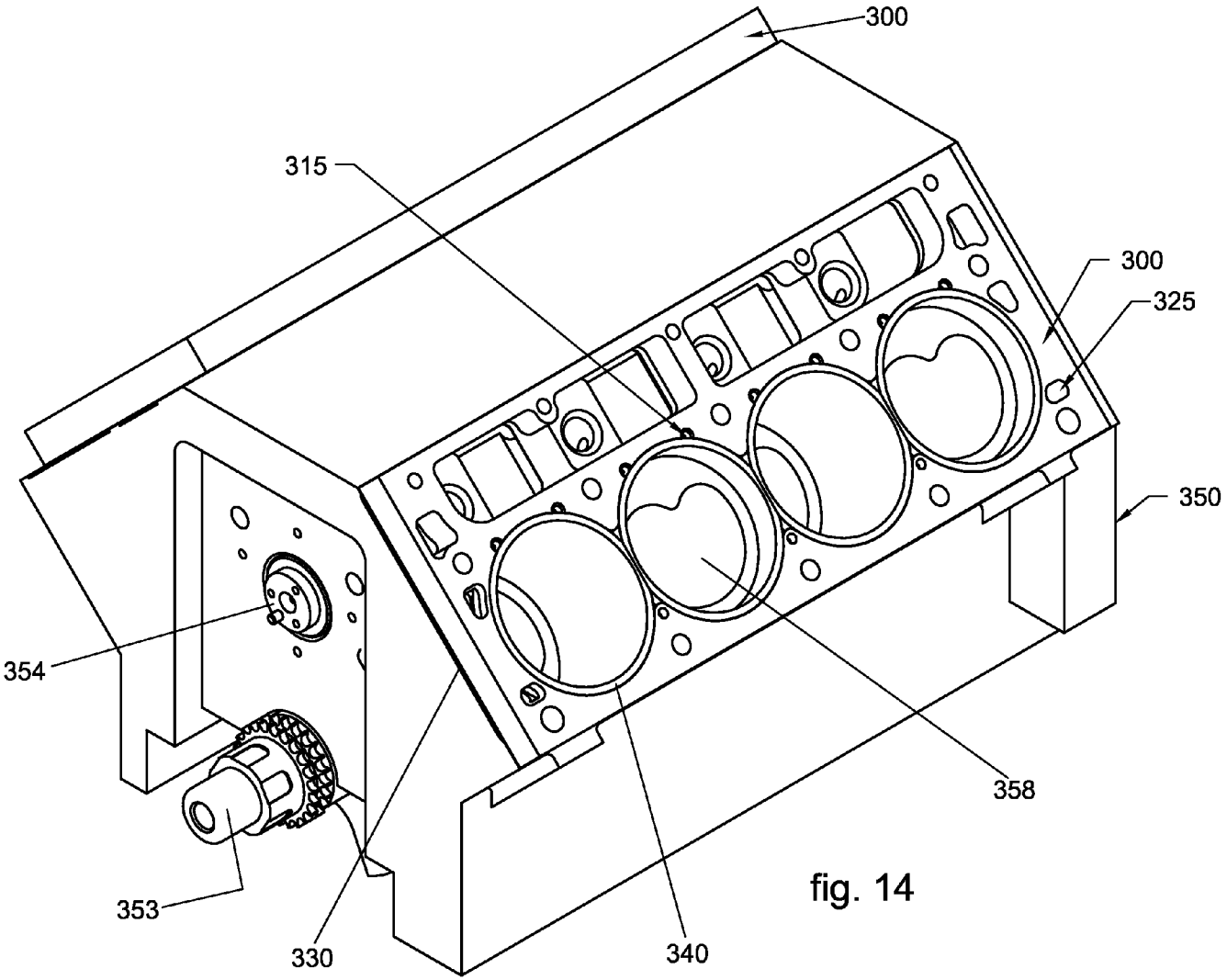
FIG. 14 is an assembled perspective view of some of the engine components illustrated in FIG. 9, but with the head gaskets, engine heads and intake spacers removed for clarity.

Referring to FIGS. 12 and 13, the openings 315 and the openings 325 may include a flared or countersunk portion 319. The flared portions 319 are useful for smoothing coolant flow between the openings 315 and 325 and their corresponding openings in the lower gasket 330, head gasket 370, engine block 350 or engine head 360 when there are sizing or alignment differences between openings 315 and 325 and their corresponding openings in the other engine components. The flared portions 319 may be of various shapes and sizes to compensate for these various alignment or sizing differences.

The placement of the numerous openings 315 in the plate 300 near the upper portion 344 of the sleeve 340 aids in cooling the upper portion 344 of the sleeve 340. Additionally, the material comprising the plate 300 may facilitate cooling of the cylinder sleeve 340 provided that a good heat conducting material is utilized, such as, for example, an aluminum material. In one preferred embodiment, the plate 300 is comprised of a material that has a coefficient of thermal expansion greater than the coefficient of thermal expansion of the cylinder sleeve. Example materials are 7075-T6 aluminum alloy with a coefficient of thermal expansion of 247 for the sleeve support plate 300 and ductile iron with a coefficient of thermal expansion of 36 for the cylinder sleeve 340.

An upper head gasket 370 (FIGS. 9, 21 and 22) may be positioned above the plate 300. The head gasket 370 may contain numerous openings 375 to accommodate the flow of cooling fluid. Other openings (unlabeled) accommodate passage of mounting hardware studs utilized to hold the assembled engine together. The head gasket 370 functions to seal potential gaps between the engine head 360, the plate 300, and the cylinder sleeves 340. The head gasket 370 may be formed of various materials, such as, for example, stainless steel, or other materials that would provide proper sealing.

Figure 9:
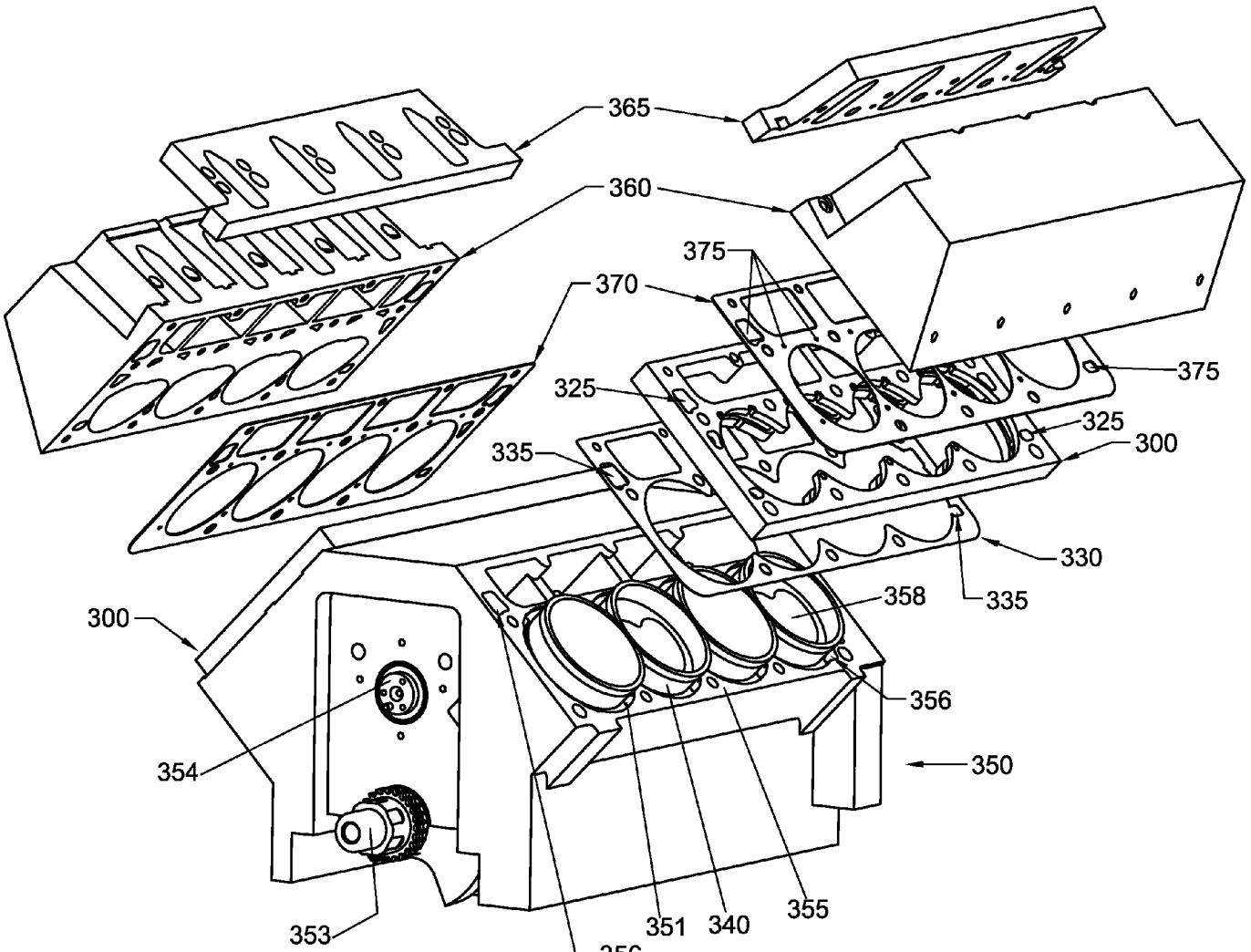
FIG. 9 is an exploded view of a portion of an internal combustion engine, including a cylinder sleeve support plate according to still another embodiment of the present invention.

Referring to FIGS. 9 and 19, the engine head 360 is positioned on top of the head gasket 370 and contains openings in a lower surface thereof to be aligned with the openings 315, 325, 335, 356 and 375 to facilitate the flow of cooling fluid between various engine components and other openings to provide passages through which mounting hardware may be placed to secure the engine together. Additionally, the head may include valves, pushrods, fluid passages and camshafts as necessary.

The stresses inflicted upon cylinder sleeves in internal combustion engines are typically increased when the replacement cylinder sleeves 340 are longer than the cylinder bores formed in the original engine block 350, such that the upper portions of the cylinder sleeves 340 extend above the upper connection (top) surface 355, also known as the upper deck, of engine block 350. While the longer cylinder sleeves have the advantage of increasing the available displacement of the combustion chamber, the additional stresses imposed on the upper portions of conventional cylinder sleeves that extend above the upper connection surface of the engine block may cause such cylinder sleeves to overheat and wear at an increased rate. The present invention provides an improved structure by reinforcing and supporting the cylinder sleeves, particularly with regard to cylinder sleeves that extend above the upper surface of the engine block.

Factors that are important to consider when manufacturing and installing the cylinder sleeve support plate 300 of the present invention include ensuring that compression of the upper gasket 370 between the cylinder sleeve 340 and the engine head 360 is maintained, that the inner surface of the cylinder sleeves 340 are not deformed, and that the cylinder sleeves 340 are laterally supported.

Because of the larger area of the plate 300 than that of sleeve top surfaces, it is conceivable that under some conditions, the plate 300 may exert a greater total force on the upper gasket 370 than the force exerted by the cylinder sleeves 340, thereby causing a relaxation of the sealing force squeezing the upper gasket 370 portions between the cylinder sleeve 340 and the cylinder head 360. Other factors, such as the difference in thermal expansion between the block 350, plate 300, and sleeves 340 and/or vibrational forces from an operating engine, can also increase these force differentials. This creates risk of very high pressure combustion gases escaping from the combustion chamber.

The thickness 321 (FIG. 12) of the plate 300 is set to prevent the plate 300 from exerting a force on the head gasket 370 and head 360 that will allow combustion gases to escape. If plate 300 were too thick in comparison to the vertical distance 392 (FIG. 17) between the upper surface 355 and the cylinder sleeve upper surface 341, thermal expansion of the engine block 350 or other forces could cause plate 300 to exert a force on upper head gasket 370 and engine head 360 sufficient to allow combustion gasses to escape. As such, the thickness of plate 300 is set to accommodate these forces and movements. In the illustrated embodiment, the thickness 321 of plate 300 is approximately 0.985 inches and the distance 392 that upper surface 341 of cylinder sleeves 340 extends above the upper deck 355 of block 350 equals approximately 1 (one) inch. These dimensions provide for the lower gasket 330 and the upper gasket 370 to be installed while allowing for the approximately 0.005 (five one-thousandths) inches of total movement between engine block 350 and head 360 that occurs in the illustrated embodiment due to, for example, expansion differences, engine vibration and torsional loads. Other thicknesses 321 of plate 300 may be used in alternate embodiments provided the thickness 321 allows for the engine to operate (for example, expand, contract, twist and vibrate) without creating excessive force on the cylinder head 360.

In order to fill the space below plate 300 while maintaining a seal sufficient to prevent cooling or lubricating fluids from leaking, a compressible lower gasket is inserted between engine block 350 and plate 300. This arrangement provides upward force on plate 300 to at least partially hold it snugly against head gasket 370 and head 360 while absorbing and/or dissipating excess upward forces from block 350 that would otherwise lessen the pressure between the head 360 and the cylinder sleeves 340 and allow combustion gases to escape. The embossments 333 in lower gasket 330 enhance the lower gasket 330's ability to accommodate relative movements between block 350 and plate 300. The ability of lower gasket 330 to vertically "expand" and "contract" helps prevent the escape of combustion gasses while maintaining sufficient compression between the block 350, lower gasket 330, plate 300, head gasket 370, and head 360 to prevent the escape of cooling and lubricating fluids.

A number of factors are considered to determine the thickness 321 of plate 300. As an example of how the proper thickness 321 of plate 300 is determined, the desired distance 392 that the top surface 341 of cylinder sleeve 340 will extend above the upper deck 355 of block 350 is first determined. If a cost-effective solution and modification of the stock engine is desired, the availability of off-the-shelf parts, for example head bolts, cylinder sleeves, timing belts and connecting rods, will affect the final value of distance 392 and are also considered. The expansion rates of the engine block 350 and cylinder sleeves 340 are used to calculate the amount that distance 392 will vary during engine operation due to the different expansion rates. The variation in the distance 392 during engine operation is used to determine the amount of movement that the lower gasket 330 and the upper gasket 370 will be required to accommodate. Typically an additional accommodation factor for vibrational loads and fit/manufacturing tolerances is added to the determined the total amount of movement that the lower gasket 330 and the upper gasket 370 will be required to accommodate. When the total amount of movement that the lower gasket 330 and the upper gasket 370 are to accommodate is determined, the thickness 321 of plate 300 can be calculated. The thicknesses and the height of the embossments of the lower gasket 330 and the head gasket 370 can also be determined using this information.

When plate 300 is installed over cylinder sleeves 340, there is a slight interference fit between the inner perimeter upper surface 302 and the upper portion 344 of the cylinder sleeve. The interference fit minimizes lateral movement of sleeve 340 while not being so tight as to cause deformation of the cylinder sleeve 340. Furthermore, the interference fit between surface 302 and upper portion 344 facilitates compression of the head gasket 370, as discussed below.

In alternate embodiments, for example those in which different materials with different coefficients of thermal expansion or differently sized parts may be used, different types of fits between inner perimeter upper surface 302 and sleeve upper portion 344 may be used. For example, press-fits and slip-fits may be used in alternate embodiment of the present invention provided that the cylinder sleeves 340 are not excessively deformed while being laterally supported by plate 300.

In order to ensure the proper interference fit between inner perimeter upper surface 302 and sleeve upper portion 344, machining of sleeve upper portion 344 may be required after sleeve 340 is installed in block 350.

The use of a compressible lower gasket allows the plate 300 to move slightly in a vertical direction in relation to the sleeve 340, engine block 300 and engine head 360 during engine operation. Forces that result in this vertical movement of plate 300 can be generated by, for example, the different expansion rates between the cylinder sleeves 340 and the block 350, the vibrations of the engine, and the torsion loads experienced by the engine during operation. As such, while the fit between the sleeve 340 and the plate 300 is snug, it is not rigid and allows the cylinder sleeve 340 and the plate 300 to move independently of each other slightly in the vertical direction during engine operation.

With the thickness 321 of plate 300 and the proper amount of compressibility of the lower gasket 330 and the head gasket 360 properly selected, the force of the plate 300 on the head 360 remains below the force of the cylinder sleeves 340 on the head 360 under normal conditions. As such, the proper compressibility of the lower gasket 330 facilitates the reliable compression and sealing of the head gasket 370 between the cylinder sleeve 340 and the engine head 360 during engine operation.

Figure 21:
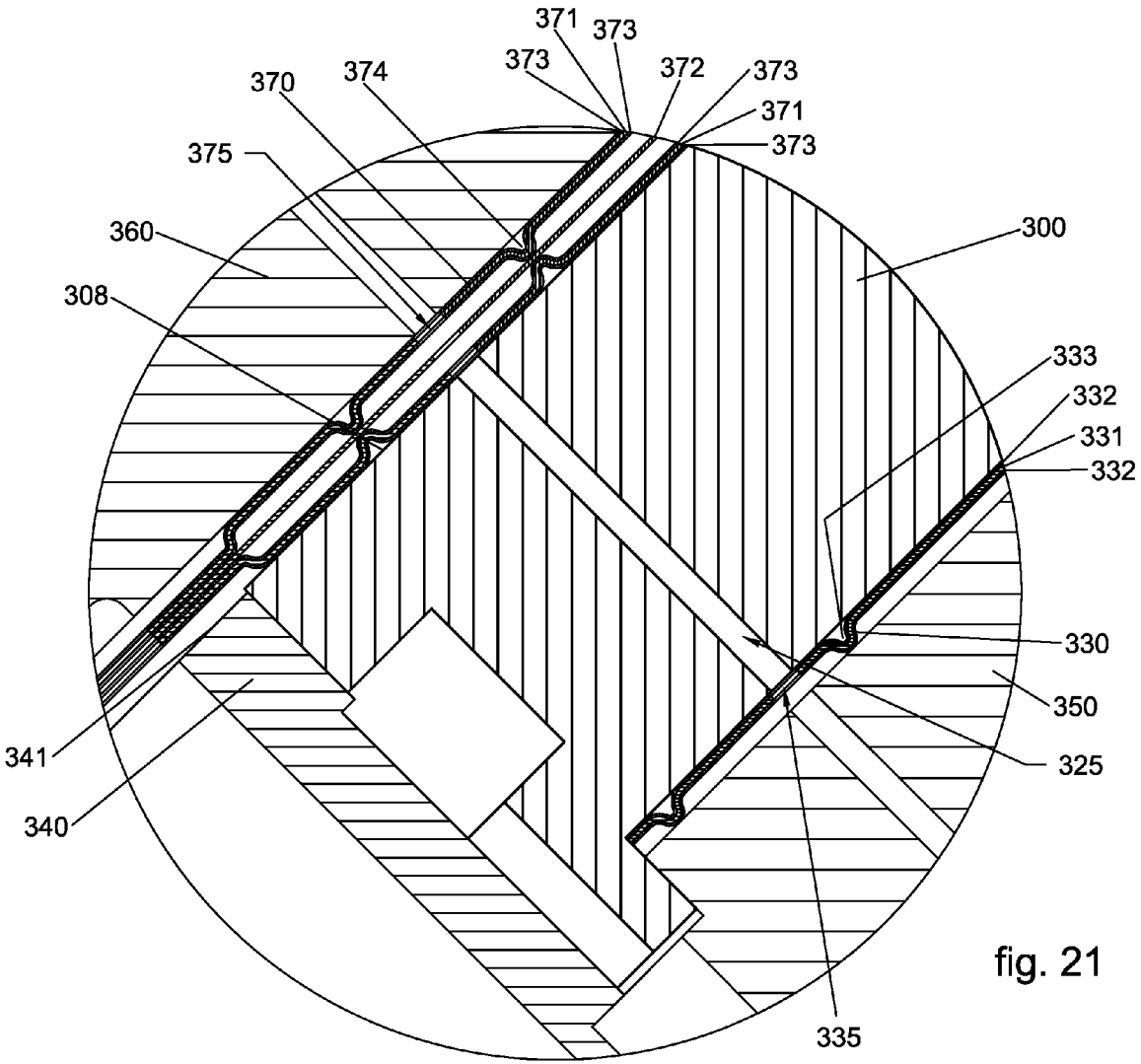
FIG. 21 is an enlarged stepped cross-sectional view of a portion of the assembled engine components illustrated in FIG. 16 taken along line 21-21 of FIG. 16, a head gasket, and an engine head prior to the engine head being fastened to engine.
Figure 22:
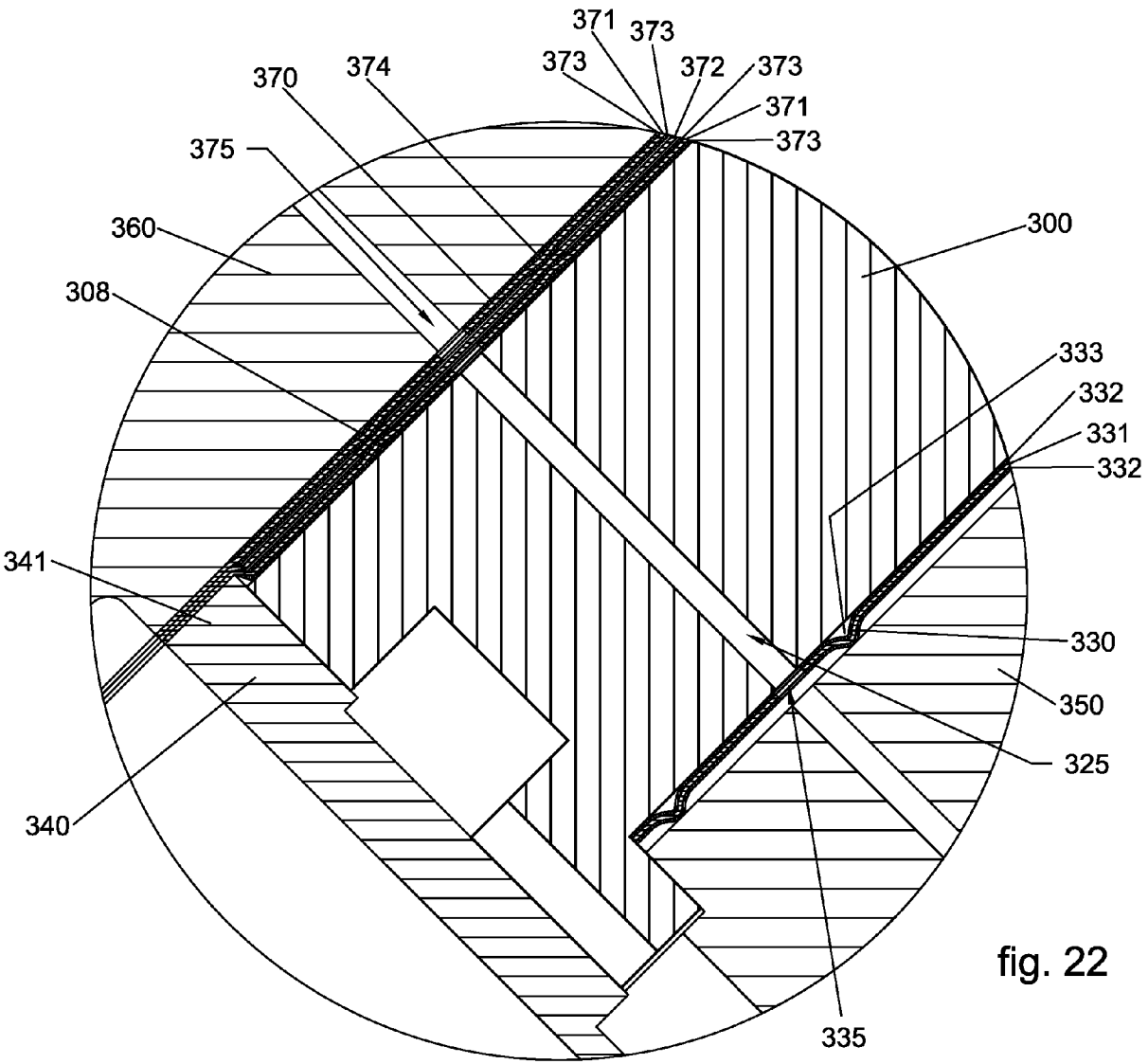
FIG. 22 is a stepped cross-sectional view of another portion of the assembled engine components illustrated in FIG. 21 after the engine head is fastened to engine.

Referring now to FIGS. 21 and 22, an example embodiment of a portion of the present invention depicting the interaction between the block 350, lower gasket 330, plate 300, head gasket 370 and the head 360 as the head 360 is bolted to the block 350 is illustrated. The relative sizes of the lower gasket 330 and the head gasket 370 are exaggerated and the dimensions and distances are modified for illustrative purposes. Head gasket 370 includes two outer layers of stainless spring steel 371 and an inner layer 372 of stainless spring steel. Each outer layer 371 is coated on both sides with a coating layer 373, for example a seal enhancing substance such as Viton®, and includes embossments 374 to help contain fluid within the passageway formed by openings 325, 375, and openings in engine head 360 aligned with openings 325 and 375. The middle layer 372 is not coated and does not include embossments. An example head gasket 370 is an off-the-shelf multi-layer steel (MLS) gasket manufactured by Cometic Gasket, Inc., part number C5317-051.

In comparison, the compressible lower gasket 330 typically comprises a layer of stainless spring steel 331 that can be coated on both sides with a layer 331 of material, for example Viton®, that can assist in the sealing function of the lower gasket 330 and compensate for surface imperfections that may be present in the spring steel while enhancing the compressibility of the lower gasket 330. In other embodiments the lower gasket can comprise other combinations of materials that would aid in preventing plate 300 from exerting excessive force on upper gasket 370 and head 360 while preventing fluid leaks from between block 350 and plate 300. The compressible lower gasket 330 further includes embossments that enhance the compressible nature of gasket 330 and the sealing nature of gasket 330 when placed, for example, around openings 335 in gasket 330. An example lower gasket 330 is a gasket custom manufactured for Electromechanical Research Laboratories, Inc. by Cometic Gasket, Inc., part number H2033SP2010S.

FIG. 21 depicts the engine block 350, lower gasket 330, plate 300, head gasket 370 and head 360 as they are positioned prior to tightening head 360 onto block 350. In this non-operational condition, head gasket 370 and lower gasket 330 are nearly fully expanded, except for a small amount of compression due to the weight of, for example, head 360.

FIG. 22, depicts the lower gasket 330, plate 300, head gasket 370 and head 360 as they are positioned after head 360 is tightened onto block 350. In this operational condition the head gasket 370 is fully compressed, and the embossments 374 have been flattened and are not readily distinguishable from the rest of head gasket 370. Portions of head gasket 370, however, may not be fully compressed in this operational condition due to, for example, surface imperfections in the upper surface 308 of plate 300. Lower gasket 330 is compressed, although less than head gasket 370.

In reference to FIGS. 17, 21 and 22, plate 300 is typically attached to sleeve 340 with the upper surface 308 of plate 300 being approximately level with the upper surface 341 of sleeve 340. The combination of this placement of plate 300 and the interference fit between the inner perimeter upper surface 302 and the upper portion 344 of the cylinder sleeve 340 tends to result in head gasket 370 being compressed more than lower gasket 330. Although the compressibility of head gasket 370 and lower gasket 330 can be somewhat comparable, the additional force created by the interference fit between upper surface 302 and upper portion 344 typically causes head gasket 370 to be compressed more than lower gasket 330. If plate 300 moves vertically during operation, the amount that head gasket 370 and lower gasket 330 are compressed will vary with the movement of the plate 300. If plate 300 is initially positioned such that the upper surface 308 is below the upper surface 341 of sleeve 340, head gasket 370 may not initially be compressed more than lower gasket 330.

In one embodiment, the lower gasket 330 is configured and arranged such that the upper surface 308 of plate 300 will be positioned slightly below the upper surface 341 of the cylinder sleeve 340 when the lower gasket 330 is fully compressed during operation of the assembled engine 380. Thus, the head-to-plate gasket compression at the head-to-sleeve-top location will be adequate to seal the combustion chamber's high pressure (thousands of pounds per square inch), while the head-to-plate compression away from the sleeve tops and plate-to-block compression remains adequate to seal the comparatively low pressure of lubricating and cooling fluids.

In the depicted embodiment, the thickness of the stainless steel layers 331, 371 and 372 is approximately 0.01 (one one-hundredth) inches and the thickness of the coating layers 332 and 373 is approximately 0.001 (one one-thousandth) inches. In alternate embodiments, head gasket 370 and lower gasket 330 may have different specific structures (location of embossments, number and arrangement of layers, presence or absence of coating layers, etc.), have different thicknesses of materials, and be made of different materials than that illustrated in the example embodiment provided they have adequate sealing and compressibility characteristics.

The combined effect of the lower gasket 330, plate 300, and head gasket 370 should be capable of absorbing or limiting the upward pressure exerted by the block 350 on the head 360 to avoid decreasing the pressure between the sleeves 340 and the head 360 to a point where combustion gasses escape. The combined effect of the lower gasket 330, plate 300, and head gasket 370 should further be capable of accommodating the motions and forces of the engine during operation (for example, expansion, contraction, twisting, and vibration) while preventing fluid (for example, cooling and lubricating fluids) from leaking between the block 350, lower gasket 330, plate 300, upper gasket 370 and head 360 as the engine expands and contracts.

Although less preferred at this moment due to the possibility of buckling the cylinder, one method to ensure that compression of the upper gasket 370 between the cylinder sleeve 340 and the engine head 360 is maintained, is to rigidly attach plate 300 to cylinder sleeve 340 with a heavy press-fit so that the upper surface of plate 300 is positioned slightly below the upper surface 341 of sleeve 340. This heavy press fit will maintain the upper surface of plate 300 below the upper surface of sleeve 340 and prevent the plate 300 from exerting a greater total force on the upper gasket 370 than the force exerted by the cylinder sleeves 340. Also less preferred at this moment due to the possibility of allowing excessive lateral movement of cylinder sleeves 340, a slip-fit between plate 300 and sleeve 340 might be used.

The engine head 360, the upper gasket 370, the sleeve support plate 300, the lower gasket 330 and the engine block 350 may be sequentially mounted together using mounting hardware (not depicted) to assemble the engine. Various types of hardware may be utilized to hold the respective parts and components of engine 380 together, including, for example, bolts, screws, studs, clips and clamps.

The steps involved in constructing the engine depicted in FIGS. 14-18 according to one embodiment of the present invention include:

1. Removing, for example boring out, the stock cylinder sleeve, which is typically made of cast iron.

2. Machining engine block 350 to accept cylinder sleeve 340, which typically includes boring out the cylinder can of engine block 350, machining annular step 351, and re-planing the top surface 355 of engine block 350.

3. Increasing the temperature of engine block 350 to approximately a normal operational temperature.

4. Installing cylinder sleeve 340 into engine block 350 by sliding the cylinder sleeve 340 into the cylinder can of the engine block 350 and pressing sleeve 340 into the cylinder can for approximately the last one inch of travel.

5. Machining flat the top surfaces of sleeves 340 and machining around the cylinder sleeve upper portion 344 to accept the inner perimeter upper surface 302 of support plate 300.

6. Machining the substantially vertical boss receiving surface 313 (FIG. 19) between step 351 and top surface 355 of engine block 350 to accept annular boss outer surface 311 of support plate 300.

7. Installing lower gasket 330 on top of engine block 350.

8. Installing cylinder sleeve support plate 300 on top of lower gasket 330 and engine block 350.

9. Honing or boring out the cylinder sleeves 340 to the required size.

Figure 23:
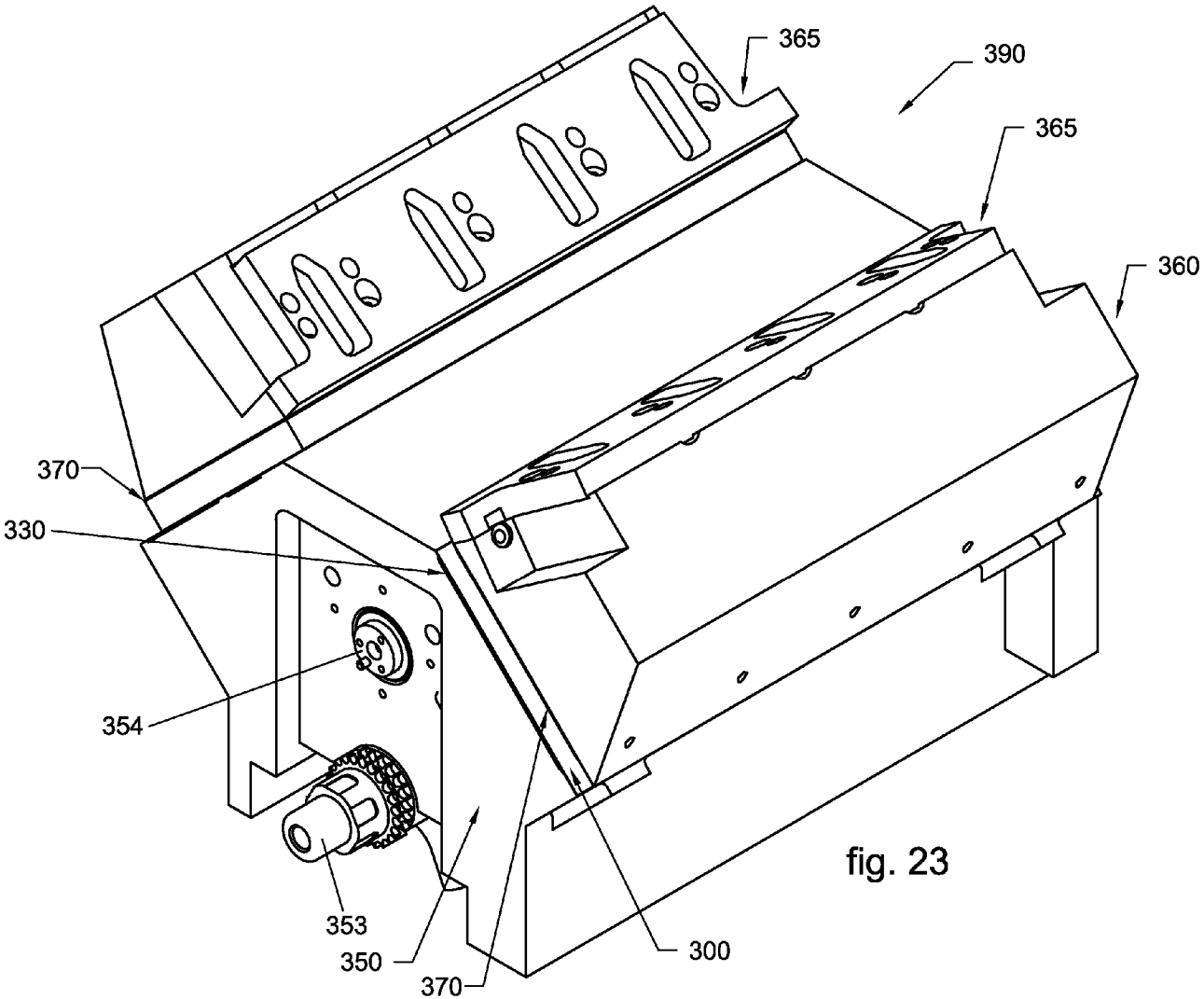
FIG. 23 is a perspective view of the engine assembled with the components illustrated in FIG. 9.

FIG. 23 depicts partially assembled engine 390, which includes the cylinder sleeve support plates 300, the lower gaskets 330, the engine block 350, the crank shaft 353, the cam shaft 354, the engine heads 360, the intake spacers 365, and the head gaskets 370. The intake spacers 365 are included to bring the distance between the faces of the engine heads 360 where the intake manifold attaches, to the same distance that an unmodified, or stock, engine would have. This allows use of standard intake manifolds despite the location of the engine heads having been moved outward.

Although the illustrated embodiment of the present invention is for use in association with an open deck engine design, which could be a closed deck engine that has been converted to an open deck design, it should be understood that aspects of the present invention may also be used in association with other engine designs where reinforcement and/or enhancement of the cooling of the cylinder sleeves is desired. Moreover, while illustrated embodiments of the present invention are shown in association with a Honda® model B16 engine or a General Motors® LS1, LS2 or LS7 engine, the invention may be applied to other engines too. In such cases, variations in the shape and configuration of the support plate and gaskets, and the locations of the openings extending therethrough may be tailored to the engine of interest. One example is the addition of push rod openings in the adapter plate and gaskets to accommodate engines that do not have overhead camshafts.

While embodiments of the invention have been illustrated and described in detail in the drawings and the foregoing description, the same is to be considered as illustrative and not restrictive in character, it being understood that they are only exemplary embodiment that have been shown and described and that all changes and modifications that come within the spirit of the invention are desired to be protected.

What is claimed is:

1. An apparatus for supporting a cylinder sleeve in a reciprocating piston internal combustion engine having an engine block with a block connection surface and having an engine head with a head connection surface, wherein the engine block and the engine head are connected to one another along their respective connection surfaces, and wherein the cylinder sleeve has a sleeve outer surface portion defining a sleeve perimeter, the apparatus comprising:

a support member connectable between the block connection surface and the head connection surface for substantially overlaying the block connection surface and for substantially underlaying the head connection surface, said support member including an inner perimeter support portion defining a groove and including a support surface, wherein said groove is adapted and configured to circulate fluid around the perimeter of the cylinder sleeve, and wherein said support surface laterally supports the sleeve outer surface portion.

2. The apparatus of claim 1, wherein said groove is adapted and configured to circulate fluid in contact with said cylinder sleeve.

3. The apparatus of claim 1, wherein said support member support surface connects to the cylinder sleeve outer surface with an interference fit.

4. The apparatus of claim 3, wherein the engine block connection surface defines a first plane and the engine block further includes a contact surface adjacent to and substantially normal to said first plane, and wherein said support member further includes a boss portion with an outer surface, wherein said boss portion outer surface and said substantially normal contact surface connect in a press-fit when said support member is mounted to the engine block.

5. The apparatus of claim 1, wherein said cylinder sleeve defines a sleeve axis and said support member is movable in the direction of said sleeve axis relative to said cylinder sleeve.

6. The apparatus of claim 1, wherein said support member further includes a plurality of cooling openings for cooling fluid communication and flow between the engine block and the engine head and through said cooling openings.

7. The apparatus of claim 6, wherein said cooling openings are formed in said support surface and form coolant passages, wherein coolant in said cooling openings is in contact with the cylinder sleeve.

8. The apparatus of claim 6, wherein at least one of said cooling openings includes at least one flared portion at an end of said cooling openings.

9. The apparatus of claim 6, wherein at least one of said cooling openings is in fluid communication with said groove.

10. The apparatus of claim 1, wherein said support member has a coefficient of thermal expansion of said inner perimeter support portion greater than the coefficient of thermal expansion of the cylinder sleeve, wherein said support member transfers heat away from the cylinder sleeve.

11. The apparatus of claim 1, wherein the cylinder sleeve extends approximately one (1) inch above the block connection surface when the sleeve is installed in the engine block and said inner perimeter support portion engages the cylinder sleeve perimeter above the block connection surface whereby the support member provides support for the cylinder sleeve.

12. A multi-cylinder internal combustion reciprocating engine cooled, at least in part, by liquid coolant, said engine comprising:

a cylinder block having a top face in a first plane;

said block having a plurality of cylinder tubes having parallel cylindrical axes substantially perpendicular to said first plane, and at least one step surface in a second plane parallel to and below said first plane;

a plurality of cylinder sleeves for receiving reciprocating engine pistons therein, one of said sleeves being secured in each of said cylinder tubes, each sleeve having an upper end, with the upper ends in a third plane parallel to and above said first plane;

each of said sleeves having an outer cylindrical wall having an upper portion; and a support plate on said block having an inner perimeter surface and a groove, said inner perimeter surface snugly engaging said upper portions of said sleeves and said groove adapted and configured to guide coolant along and around said upper portions of said sleeves when the engine is operating.

13. The engine of claim 12, wherein said groove is in said inner perimeter surface for guiding coolant along said groove in contact with said cylinder sleeves outer cylindrical walls.

14. The engine of claim 12, wherein said support plate includes a boss portion with an outer surface, and said block includes a boss receiving surface extending downward from said cylinder block top face; and wherein said receiving surface engages said boss outer surface with a press-fit.

15. The engine of claim 14, wherein said inner perimeter surface engages said upper portions of said cylinder sleeves with an interference fit.

16. The engine of claim 12, wherein said support plate is movable in the direction of said cylindrical axes relative to said cylinder sleeves.

17. The engine of claim 12, wherein said support plate further includes a plurality of cooling openings for cooling fluid communication and flow between the engine block and an engine head and through said cooling openings, wherein at least one of said cooling openings is in fluid communication with said groove.

18. The engine of claim 5, wherein said support plate further includes a boss portion with an outer surface, and said engine further comprises:

a first gasket with at least one opening, said first gasket connectable between the block top face and the support plate with said boss portion outer surface received in said at least one opening;

an engine head; and a second gasket connectable between said cylinder sleeve and said engine head and between said support plate and said engine head, wherein said first gasket is more compliant than said second gasket and accommodates relative movement between said plate and said block.

19. An apparatus for use within a liquid cooled reciprocating piston internal combustion engine having a cylinder sleeve mounted to an engine block and an engine head mounted to the engine block, and having a cooling fluid, the apparatus comprising:

means for maintaining a specified separation between the engine block and the engine head using a plate mounted between the engine block and the engine head wherein the plate is further mounted to the cylinder sleeve;

means for cooling the cylinder sleeve using a groove in the plate that provides for direct contact between the cooling fluid and the cylinder sleeve; and means for minimizing lateral movement of the cylinder sleeve using the plate.

20. The apparatus of claim 19, wherein the cylinder sleeve defines a sleeve axis and the plate is movable in the direction of the sleeve axis relative to the cylinder sleeve, and wherein the plate mounts to the engine block with an interference fit, and the plate further mounts to the cylinder sleeve with an interference fit.

21. An internal combustion reciprocating engine comprising:

a cylinder block with a flat surface block top and a plurality of combustion cylinders extending downward from the top;

a cylinder liner sleeve in each of said cylinders;

a plate mounted on said block top and having a plate top and a plate bottom and having a hole through the plate from the plate top to the plate bottom, the hole having an inner perimeter wall engaging upper portions of said sleeves throughout more than half the circumference of said upper portions of said sleeves;

a cylinder head mounted on said sleeves and covering said cylinder sleeves;

at least one coolant passageway extending through said block and said plate and having a portion defined by said portions of said sleeves engaged by said inner perimeter wall of said plate, whereby coolant moved through said defined portion of said passageway directly contacts said sleeves.

22. The engine of claim 21 and wherein:

said plate has a boss extending downward from the plate bottom around the perimeter of said hole and which defines a portion of said inner perimeter wall, said boss extending downward into said block and frictionally engaging said block and indexed by said block to prevent lateral movement of said plate relative to said block top.

23. The engine of claim 22 and wherein said defined portion of said coolant passageway extends on a plane parallel to said flat surface of said block top and above said block top.

24. The engine of claim 22 and further comprising:

a first gasket having a first portion sandwiched between said head and said sleeves and a second portion sandwiched between said head and said plate; and a second gasket which is compressed and sandwiched between said plate and said block.

25. The engine of claim 24 and wherein:

said first gasket has a plurality of combustion passage holes, one of said passage holes for each cylinder sleeve and providing communication between the sleeve and the head; and said first gasket portion is more compressed than said second gasket portion.

26. Engine of claim 25 and wherein said second portion of said first gasket is more compressed than said second gasket.

* * * * *